US011455962B2

(12) United States Patent
Shan

(10) Patent No.: US 11,455,962 B2
(45) Date of Patent: Sep. 27, 2022

(54) DRIVING METHOD AND SYSTEM OF DISPLAY ASSEMBLY, AND DISPLAY DEVICE

(71) Applicants: CHONGQING HKC OPTOELECTRONICS TECHNOLOGY CO., LTD., Chongqing (CN); HKC CORPORATION LIMITED, Shenzhen (CN)

(72) Inventor: Jianfeng Shan, Shenzhen (CN)

(73) Assignees: CHONGQING HKC OPTOELECTRONICS TECHNOLOGY CO., LTD., Chongqing (CN); HKC CORPORATION LIMITED, Shenzhen (CN)

( * ) Notice: Subject to any disclaimer, the term of this patent is extended or adjusted under 35 U.S.C. 154(b) by 0 days.

(21) Appl. No.: 17/415,755

(22) PCT Filed: Mar. 9, 2020

(86) PCT No.: PCT/CN2020/078391
§ 371 (c)(1),
(2) Date: Jun. 18, 2021

(87) PCT Pub. No.: WO2020/207168
PCT Pub. Date: Oct. 15, 2020

(65) Prior Publication Data

US 2022/0084476 A1 Mar. 17, 2022

(30) Foreign Application Priority Data

Apr. 8, 2019 (CN) ..... 201910275200.0
Apr. 8, 2019 (CN) ..... 201910275212.3

(51) Int. Cl.
*G09G 3/34* (2006.01)
*G09G 3/36* (2006.01)

(52) U.S. Cl.
CPC ..... *G09G 3/3413* (2013.01); *G09G 3/3426* (2013.01); *G09G 3/3607* (2013.01);
(Continued)

(58) Field of Classification Search
CPC .. G09G 3/3413; G09G 3/3426; G09G 3/3607; G09G 2320/0233; G09G 2320/068; G09G 2340/06; G09G 2360/16
See application file for complete search history.

(56) References Cited

U.S. PATENT DOCUMENTS

2004/0263456 A1* 12/2004 Miyachi ..... G09G 3/3607 345/88
2008/0150863 A1* 6/2008 Morisue ..... G09G 3/3406 345/88

(Continued)

FOREIGN PATENT DOCUMENTS

CN 109461417 A 3/2019
CN 109509436 A 3/2019

(Continued)

OTHER PUBLICATIONS

Chang Liu, the ISA written comments, Jun. 2020, CN.
Chang Liu, the International Search Report, dated Jun. 2020, CN.

*Primary Examiner* — Roberto W Flores

(57) ABSTRACT

The present application discloses a driving method and driving system of a driving module, and a display device. A driving process of the display panel includes: receiving a first color signal and converting it into a first HSV (hue, saturation, value) spatial signal; adjusting a first saturation signal to obtain a second saturation signal; using a second color signal converted from the second saturation signal to drive the display panel. A driving process of the backlight (Continued)

module includes: receiving the first color signal to obtain a light source adjustment coefficient; determining the minimum color light source and using the light source adjustment coefficient to adjust the minimum color light source to obtain a fourth brightness value; driving the minimum color light source using the fourth brightness value.

20 Claims, 9 Drawing Sheets

(52) U.S. Cl.
CPC ..... *G09G 2320/0233* (2013.01); *G09G 2320/068* (2013.01); *G09G 2340/06* (2013.01)

(56) References Cited

U.S. PATENT DOCUMENTS

| | | | | |
|---|---|---|---|---|
| 2009/0160747 | A1* | 6/2009 | Morisue | G09G 3/3406 345/589 |
| 2012/0194537 | A1* | 8/2012 | Huang | G09G 5/02 345/589 |
| 2019/0221171 | A1* | 7/2019 | Zha | G09G 3/3426 |

FOREIGN PATENT DOCUMENTS

| | | | |
|---|---|---|---|
| CN | 109559692 | A | 4/2019 |
| CN | 110111744 | A | 8/2019 |
| CN | 110189717 | A | 8/2019 |
| JP | 2010079119 | A | 4/2010 |

* cited by examiner

DRIVING METHOD AND SYSTEM OF DISPLAY ASSEMBLY, AND DISPLAY DEVICE

CROSS REFERENCE OF RELATED APPLICATIONS

This application claims the priority to and benefit of Chinese patent application CN201910275200.0, entitled "Driving Method and System of Display assembly, and Display Device" and filed Apr. 8, 2019, and Chinese patent application number CN201910275212.3, entitled "Driving Method and System of Display assembly, and Display Device" and filed Apr. 8, 2019, with China National Intellectual Property Administration, the entire contents of which are incorporated herein by reference.

TECHNICAL FIELD

This application relates to the field of display technology, and more particularly relates to a driving method and system of a display assembly, and a display device.

BACKGROUND

The statements herein merely provide background information related to the present application but don't necessarily constitute the prior art.

As science and technology continue to develop and progress, liquid crystal displays (LCDs) have become the mainstream forms of displays due to their thin body, power saving, and low radiation, and have been widely used. Most of the LCDs are backlit-type LCDs, which include a liquid crystal panel and a backlight module. The working principle of the liquid crystal panel consists in placing liquid crystal molecules between two parallel glass substrates, and applying a driving voltage to the two glass substrates to control the rotational direction of the liquid crystal molecules thus refracting light emitted from the backlight module to produce pictures.

In an undisclosed solution used by the inventor, the saturation of the signal is adjusted to mitigate the color shift issue, but doing so will cause loss in the presentation of the saturation of the signal.

SUMMARY

In view of the above, it is therefore an object of this application to provide a driving method and system for a display assembly, and a display device, which can reduce the color shift while maintaining color purity performance.

The present application discloses a driving method of a display assembly, the driving a driving process of a display panel and a driving process of a backlight module that are synchronously performed.

The backlight module includes a plurality of independently controlled light sources, including a first color light source, a second color light source, and a third color light source. The corresponding light source brightness of the first color light source is a first brightness value, the corresponding light source brightness of the second color light source is a second brightness value, and the corresponding light source brightness of the third color light source is a third brightness value.

The driving process of the display panel includes the following operations:

receiving a first color signal corresponding to the display panel, converting the first color signal into first brightness normalized signals, and converting the first brightness normalized signals into a first HSV (hue, saturation, value) signal;

adjusting a first saturation signal of the first HSV spatial signal using a preset adjustment coefficient to obtain a second saturation signal;

converting the second saturation signal into a second color signal; and driving the display panel using the second color signal.

The driving process of the backlight module includes the following operations:

receiving the first color signal corresponding to the display panel, and obtaining the first saturation signal and the second saturation signal;

determining a minimum color light source among the first color light source, the second color light source, and the third color light source, and obtaining a light source adjustment coefficient corresponding to the minimum color light source based on the first saturation signal and the second saturation signal; and driving the minimum color light source using a fourth brightness value.

The present application further discloses a driving system of a display assembly using a driving method of the display assembly, the driving system including: a driving circuitry of a display panel and a driving circuitry of a backlight module, the display panel and the backlight module being driven synchronously. The backlight module includes a plurality of independently controlled light sources, including a first color light source, a second color light source, and a third color light source. The corresponding light source brightness of the first color light source is a first brightness value, the corresponding light source brightness of the second color light source is a second brightness value, and the corresponding light source brightness of the third color light source is a third brightness value. The driving circuitry of the display panel includes a receiver configured for receiving a first color signal corresponding to the display panel, converting the first color signal into first brightness normalized signals, and converting the first brightness normalized signals into a first HSV (hue, saturation, value) signal; an adjuster configured for adjusting a first saturation signal of the first HSV spatial signal using a preset adjustment coefficient to obtain a second saturation signal; a converter configured for converting the second saturation signal into a second color signal; and a driver configured for driving the display panel using the second color signal. The driving circuitry of the backlight module includes a receiver configured for receiving the first color signal corresponding to the display panel, and obtaining the first saturation signal and the second saturation signal; a light source determiner configured for determining a minimum color light source among the first color light source, the second color light source, and the third color light source, and obtaining a light source adjustment coefficient corresponding to the minimum color light source based on the first saturation signal and the second saturation signal; a light source adjuster configured for adjusting the minimum color light source using the light source adjustment coefficient to obtain a fourth brightness value; and a light source driver configured for driving the minimum color light source using the fourth brightness value.

The present application further discloses a display device, including a display assembly and a driving system of the display assembly. The driving system of the display assembly includes a drive circuitry of a display panel and a drive circuitry of a backlight module, the display panel and the backlight module being driven synchronously. The backlight module includes a plurality of independently controlled light sources, including a first color light source, a second color light source, and a third color light source. The corresponding light source brightness of the first color light source is a first brightness value, the corresponding light source brightness of the second color light source is a second brightness value, and the corresponding light source brightness of the third color light source is a third brightness value. The driving circuitry of the display panel includes a receiver configured for receiving a first color signal corresponding to the display panel, converting the first color signal into first brightness normalized signals, and converting the first brightness normalized signals into a first HSV (hue, saturation, value) signal; an adjuster configured for adjusting a first saturation signal of the first HSV spatial signal using a preset adjustment coefficient to obtain a second saturation signal; a converter configured for converting the second saturation signal into a second color signal; and a driver configured for driving the display panel using the second color signal. The driving circuitry of the backlight module includes a receiver configured for receiving the first color signal corresponding to the display panel, and obtaining the first saturation signal and the second saturation signal; a light source determiner configured for determining a minimum color light source among the first color light source, the second color light source, and the third color light source, and obtaining a light source adjustment coefficient corresponding to the minimum color light source based on the first saturation signal and the second saturation signal; a light source adjuster configured for adjusting the minimum color light source using the light source adjustment coefficient to obtain a fourth brightness value; and a light source driver configured for driving the minimum color light source using the fourth brightness value; where the display assembly includes the display panel the a backlight module.

Compared with the scheme of dividing a pixel of the display panel into a main pixel and a sub-pixel to mitigate the color shift problem, an exemplary technique includes adjusting the first saturation to obtain a second saturation, converting the second saturation into a second color signal, and driving the display panel using the second color signal, which can well improve the color shift problem. However, due to the adjustment of the saturation value, the image quality and the saturation will be lacking. This application obtains the light source adjustment coefficient based on the first saturation signal and the second saturation signal to adjust the brightness of the minimum color light source, which improves the hue that experiences loss of saturation, and even enables the adjusted color point return to the original saturated color point in conjunction with the adjusted light source intensity, thereby maintaining the color purity performance while reducing the viewing angle color shift.

BRIEF DESCRIPTION OF DRAWINGS

The drawings included herein are intended to provide a further understanding of the embodiments of the present application. They constitute a part of the specification, and are used to illustrate the embodiments of the present application, and explain the principle of the present application in conjunction with the specification. Apparently, the drawings in the following description merely represent some embodiments of the present disclosure, and for those having ordinary skill in the art, other drawings may also be obtained based on these drawings without investing creative efforts. In the drawings.

DETAILED DESCRIPTION OF EMBODIMENTS

Large-size liquid crystal display panels mostly use negative-type VA (Vertical Alignment) liquid crystal technology or IPS (In-Plane switching) liquid crystal technology. Compared with IPS liquid crystal technology, VA liquid crystal technology has advantages of higher efficiency of production and lower manufacturing costs. However, VA liquid crystal technology has obvious optical defects in terms of optical properties compared with IPS liquid crystal technology, which is significant particularly in commercial applications of large-size panels that require a larger viewing angle.

Figure 1:
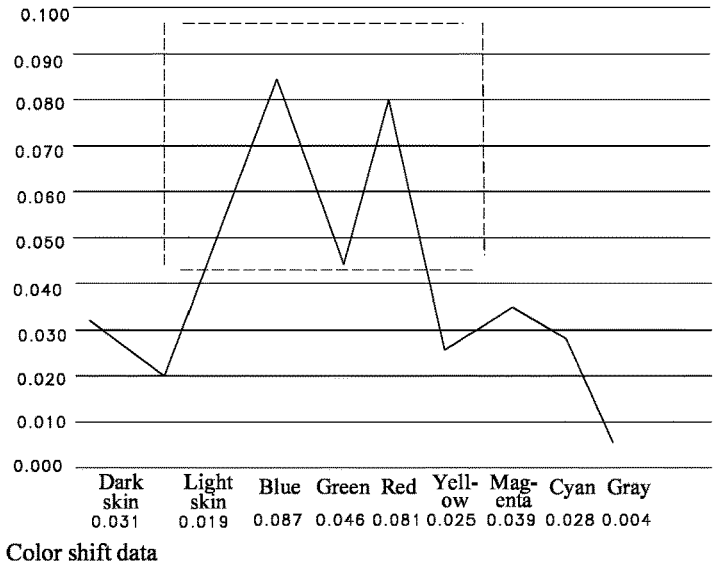
FIG. 1 is a schematic diagram illustrating the changes in the color shifts of various representative color systems in an LCD between a large viewing angle and a front viewing angle.

FIG. 1 is a schematic diagram illustrating the changes in the color shifts of various representative color systems in a liquid crystal display panel between a large viewing angle and a front viewing angle. As illustrated in FIG. 1, when the hue is located close to the pure hues of R (red), G (green), and B (blue), the color shift degradation of viewing angle is relatively significant. In addition, when the hue is close to the pure hues of R, G, and B, the color shift phenomenon becomes more significant. The reason is that the pure hues of R, G, and B have other color components.

Figure 2:
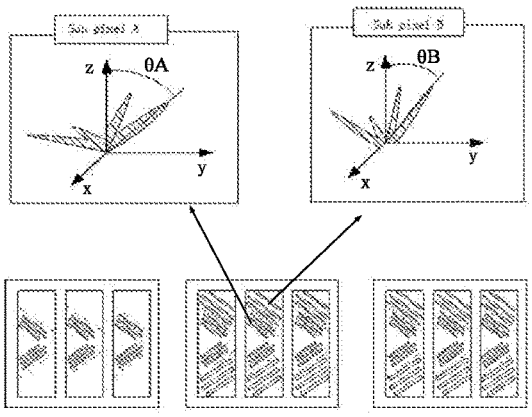
FIG. 2 is a first schematic diagram illustrating dividing an original pixel into a main pixel and a sub-pixel according to an example solution.
Figure 3:
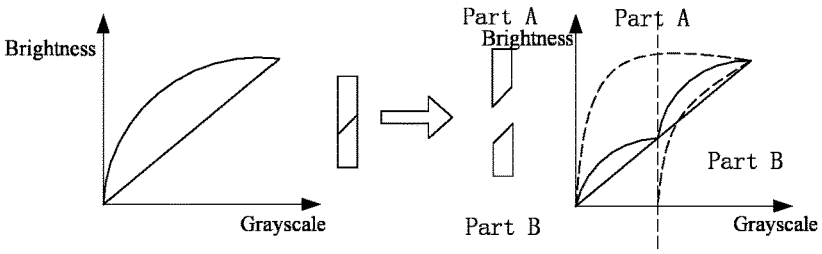
FIG. 3 is a second schematic diagram illustrating dividing an original pixel into a main pixel and a sub-pixel according to an example solution.

An exemplary solution is to subdivide each sub-pixel of RGB into a main pixel and a sub-pixel, so that the changes in the overall large viewing angle brightness along with the voltage may become relatively closer to those in the front view. FIG. 2 is a first comparison diagram illustrating a comparison between the case which uses separate main and sub-pixels and the case which doesn't use main and sub-pixels. FIG. 3 is a second comparison diagram illustrating a comparison between the case which uses separate main and sub-pixels and the case which doesn't use main and sub-pixels. Referring to FIGS. 2 and 3, the x-coordinate, y-coordinate, and z-coordinate respectively represent the three orientations of the three-dimensional space, θA represents the pretilt angle of the main pixel under a large voltage, and OB represents the pretilt angle of the sub-pixel under a small voltage. In FIG. 3, the abscissa denotes the gray-scale signal, and the ordinate denotes the brightness signal. Under a large viewing angle, the brightness saturates rapidly with the signal, causing the problem of large viewing angle color shift (FIG. 3, the arc segment on the left), while distinguishing between main and sub-pixels can alleviate this problem to a certain extent.

The ratio of brightness change to the high voltage side viewing angle voltage on the liquid crystal display is more likely to become saturated, so the original signal is divided into a large voltage plus a small voltage signal. As is illustrated in FIG. 3, the front-view large voltage plus small voltage need to maintain the original front-view signal change ratios with brightness. The variation of the side-view brightness with the gray scale seen at the high voltage is represented by Part A shown in FIG. 3, and the variation of the side-view brightness with the gray scale seen at the small voltage is represented by Part B shown in FIG. 3. In this way, the variation of the combined brightness seen at the side-view with the gray scale would be closer to the relationship between the brightness at the front view with the gray scale, so that the relationship of variation of the viewing angle brightness with the signal would approach the original variation of the signal brightness with the signal, thus improving the viewing angle.

In this solution, the main and sub-pixels are spatially give different driving voltages to solve the viewing angle color shift defects. However, such pixel design often requires redesigning the metal traces or TFT (Thin Film Transistor) elements for purposes of driving the sub-pixels, resulting in sacrifice of the light transmittable opening area, which affects the transmittance of the panel and directly causes the increase in the cost of the backlight.

Hereinafter, this application will be described in further detail in connection with the drawings and some optional embodiments.

Figure 4:
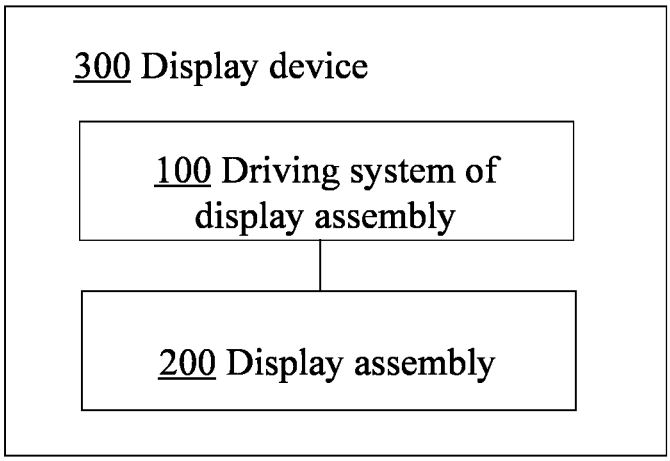
FIG. 4 is a block diagram of a display device according to an embodiment of this application.

As illustrated in FIG. 4, the present application discloses a display device 300, which includes a display assembly 200 and a driving system 100 of the display assembly 200, where the display assembly 200 includes a display panel and a backlight module.

Figure 5:
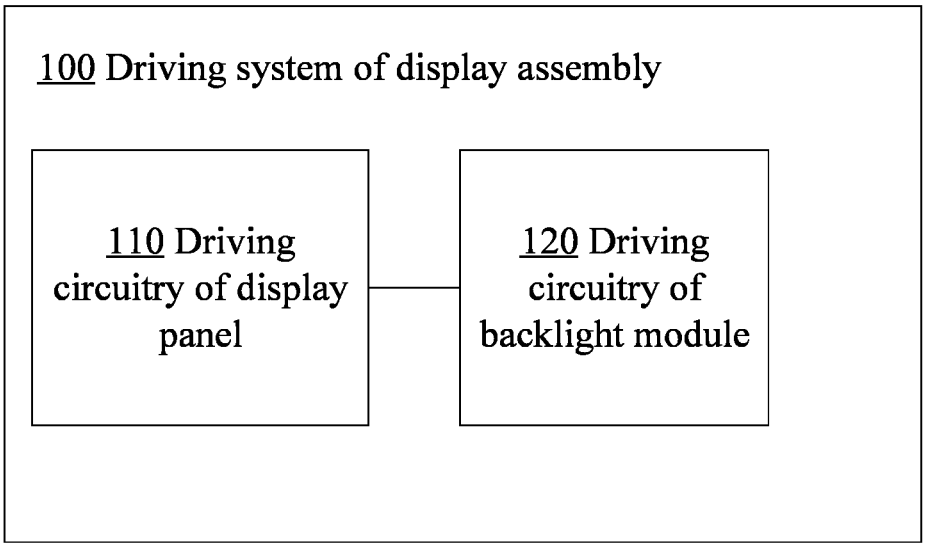
FIG. 5 is a block diagram of a driving system of a display assembly according to an embodiment of this application.
Figure 6:
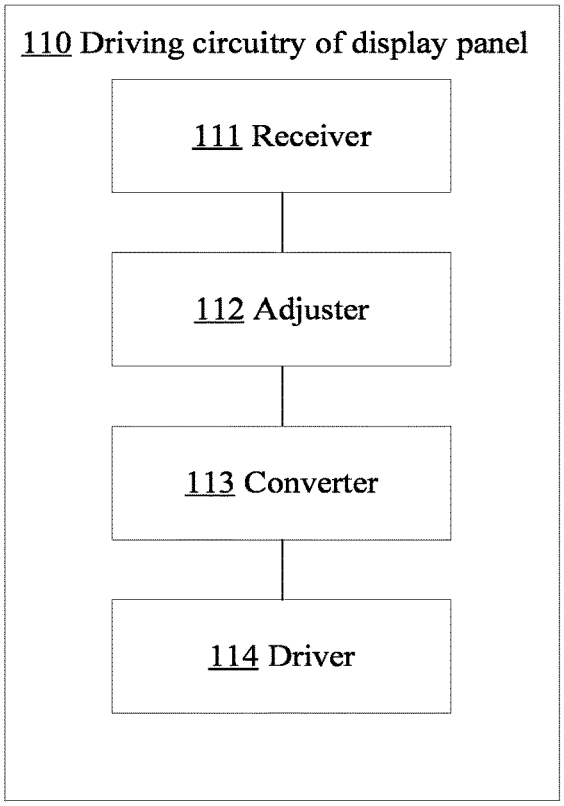
FIG. 6 is a block diagram of a driving circuitry of a display panel according to an embodiment of this application.
Figure 7:
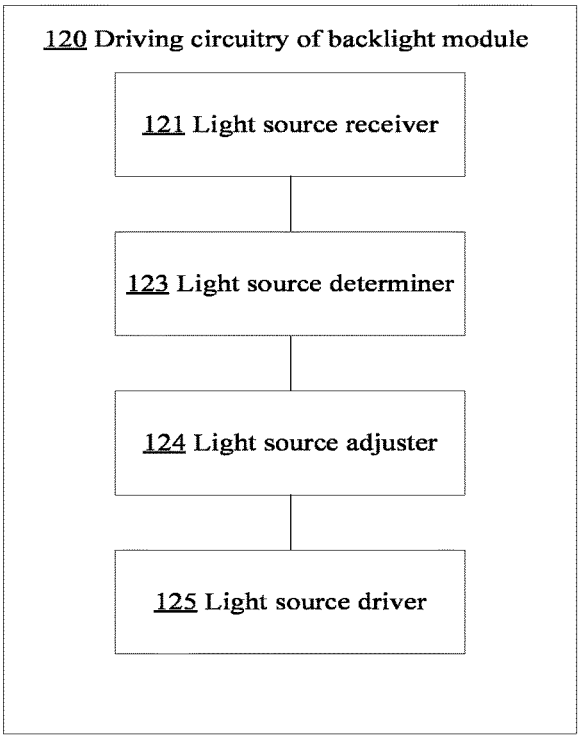
FIG. 7 is a block diagram of a driving circuitry of a backlight module according to an embodiment of this application.

As illustrated in FIG. 5, FIG. 6 and FIG. 7, the present application further discloses a driving system 100 for a display assembly. The driving method for the display assembly described later in this paper is applied to the driving system 100 for the display assembly disclosed herein. The driving system 100 of the display assembly includes a driving circuitry 110 of a display panel and a driving circuitry 120 of a backlight module, where the display panel and the backlight module are driven synchronously.

The backlight module includes at least one backlight subarea, and each backlight subarea includes a first color light source, a second color light source, and a third color light source that are independently controlled. The corresponding light source brightness of the first color light source is a first brightness value, the corresponding light source brightness of the second color light source is a second brightness value, and the corresponding light source brightness of the third color light source is a third brightness value.

The driving circuitry 110 of the display panel includes a receiver 111, an adjuster 112, a converter 113, and a driver 114. The receiver 111 receives a first color signal corresponding to the display panel, converts the first color signal into first brightness normalized signals, and converts the first brightness normalized signals into a first HSV (hue, saturation, value) signal. The adjuster 112 adjusts a first saturation signal of the first HSV spatial signal by a preset adjustment coefficient to obtain a second saturation signal. The converter 113 converts the second saturation signal into a second color signal. And the driver 114 drives the display panel using the second color signal.

The driving circuitry 120 of the backlight module includes a light source receiver 121, a light source determiner 123, a light source adjuster 124, and a light source driver 125. The light source receiver 121 receives the first color signal corresponding to the display panel, and obtains the first saturation signal and the second saturation signal. The light source determiner 123 determines the minimum color light source among the first color light source, the second color light source, and the third color light source, and obtains a light source adjustment coefficient corresponding to the minimum color light source based on the first saturation signal and the second saturation signal. The light source adjuster 124 uses the light source adjustment coefficient to adjust the minimum color light source to obtain a fourth brightness value. And the light source driver 125 uses the fourth brightness value to drive the minimum color light source.

Figure 8:
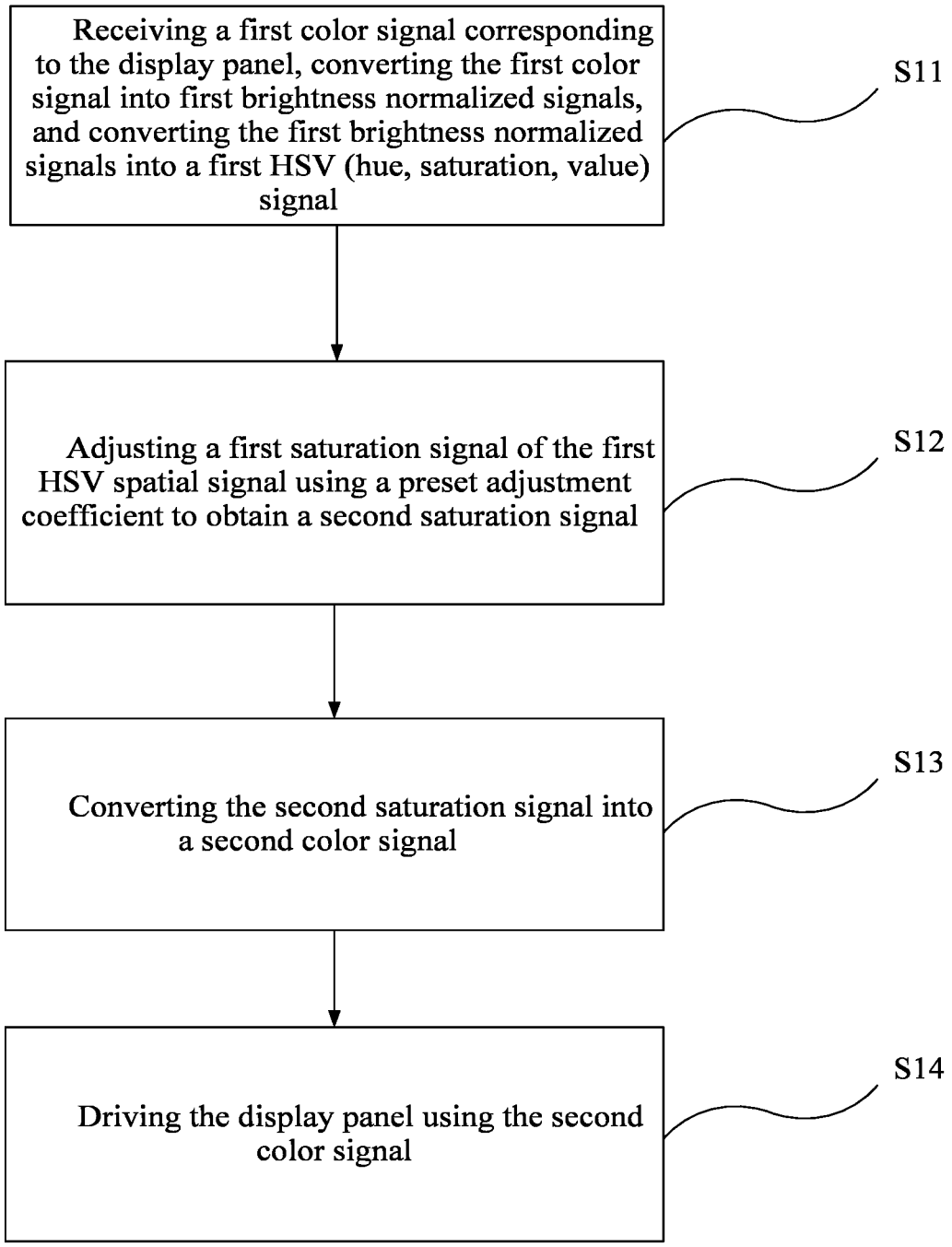
FIG. 8 is a flowchart illustrating a driving method of a display assembly according to an embodiment of this application.
Figure 9:
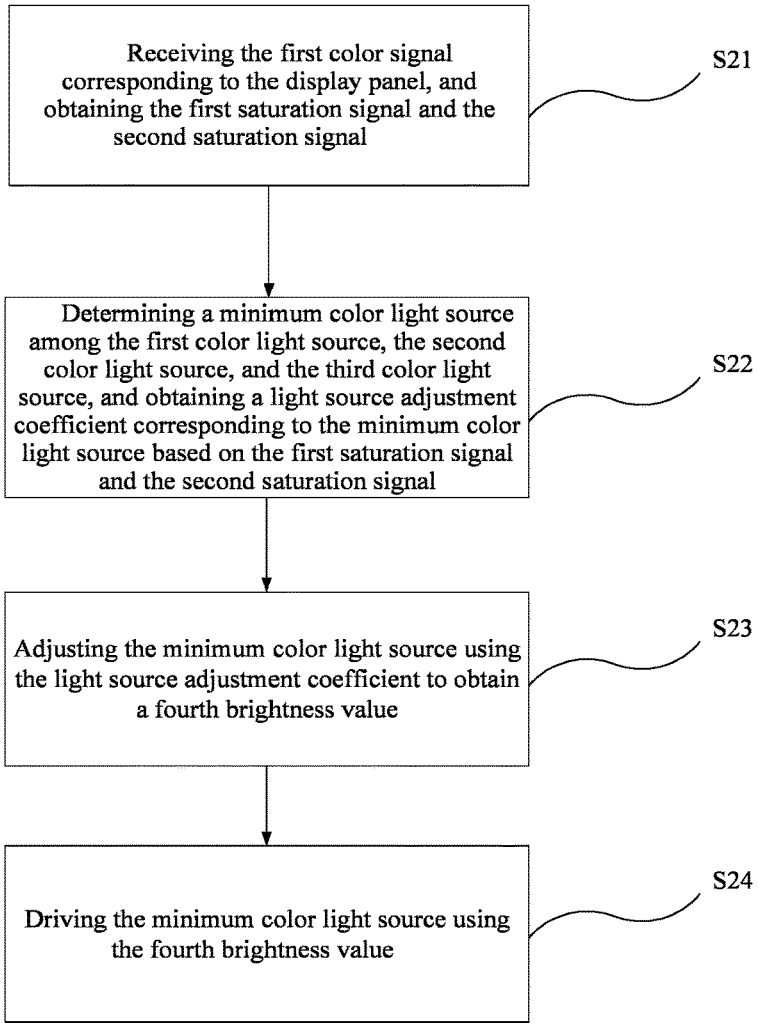
FIG. 9 is a flowchart illustrating a driving method of a display assembly according to another embodiment of this application.

As illustrated in FIG. 8 and FIG. 9, the present application further discloses a driving method of a display assembly, the driving a driving process of a display panel and a driving process of a backlight module that are synchronously performed.

The backlight module includes a plurality of independently controlled light sources, including a first color light source, a second color light source, and a third color light source. The corresponding light source brightness of the first color light source is a first brightness value, the corresponding light source brightness of the second color light source is a second brightness value, and the corresponding light source brightness of the third color light source is a third brightness value.

The driving process of the display panel includes the following operations:

S11: receiving a first color signal corresponding to the display panel, converting the first color signal into first brightness normalized signals, and converting the first brightness normalized signals into a first HSV (hue, saturation, value) signal;

S12: adjusting a first saturation signal of the first HSV spatial signal using a preset adjustment coefficient to obtain a second saturation signal;

S13: converting the second saturation signal into a second color signal; and

S14: driving the display panel using the second color signal;

The driving process of the backlight module includes the following operations:

S21: receiving the first color signal corresponding to the display panel, and obtaining the first saturation signal and the second saturation signal;

S22: determining a minimum color light source among the first color light source, the second color light source, and the third color light source, and obtaining a light source adjustment coefficient corresponding to the minimum color light source based on the first saturation signal and the second saturation signal; and S23: a light source adjuster configured for adjusting the minimum color light source using the light source adjustment coefficient to obtain a fourth brightness value; and S24: driving the minimum color light source using a fourth brightness value.

Compared with the solution of dividing a pixel of the display panel into a main pixel and a sub-pixel to mitigate the color shift problem, an exemplary technique includes adjusting the first saturation to obtain a second saturation, converting the second saturation into a second color signal, and driving the display panel using the second color signal, which can well improve the color shift problem. However, due to the adjustment of the saturation value, the image quality and the saturation will be lacking. This application obtains the light source adjustment coefficient based on the first saturation signal and the second saturation signal to adjust the brightness of the minimum color light source, which improves the hue that experiences loss of saturation, and even enables the adjusted color point return to the original saturated color point in conjunction with the adjusted light source intensity, thereby maintaining the color purity performance while reducing the viewing angle color shift. In the above description, the color signals can be an RGB three primary-color-signals. In particular, the first color signal may be a first RGB three primary-color-signal, and the second color signal may be a second RGB three primary-color-signal.

The operation of adjusting the first saturation signal of the first HSV spatial signal using the preset adjustment coefficient to obtain a second saturation signal may include:

obtaining the second saturation signal S'n_i,j from the first saturation signal Sn_i,j through the following formula:

$$S'n_i,j=a\times S^4n_i,j+b\times S^3n_i,j+c\times S^2n_i,j+d\times Sn_i,j+e;$$

where a, b, c, d, e are preset adjustment coefficients.

The operation of converting the second saturation signal into the second color signal may include: converting the second saturation signal to obtain a second HSV spatial signal, and turning down the minimum value of the brightness normalized signals according to the second HSV spatial signal to obtain second brightness normalized signals; and converting the second brightness normalized signals to obtain the second color signal.

The operation of determining the minimum color light source among the first color light source, the second color light source, and the third color light source, and obtaining the light source adjustment coefficient corresponding to the minimum color light source based on the first saturation signal and the second saturation signal may include: determining the middle color light source and the minimum color light source among the first color light source, the second color light source, and the third color light source; obtaining the light source adjustment coefficient corresponding to the minimum color light source and the light source adjustment coefficient corresponding to the middle color light source based on the first saturation signal and the second saturation signal;

The operation of adjusting the minimum color light source using light source adjustment coefficient to obtain the fourth brightness value, and driving the minimum color light source using the fourth brightness value may include: adjusting the minimum color light source using the light source adjustment coefficient corresponding to the minimum color light source to obtain the fourth brightness value, and adjusting the middle color light source using the light source adjustment coefficient corresponding to the middle color light source to obtain a fifth brightness value; driving the minimum color light source using the fourth brightness value, and driving the middle color light source using the fifth brightness value.

This application not only uses the fourth brightness value to drive the minimum color light source, but also uses the fifth brightness value to drive the middle color light source, so that both the minimum color light source and the middle color light source can enhance the corresponding under-displayed hues to make them return to the original saturated color points, thereby maintaining the color purity of the hues corresponding to the minimum color light source and the middle color light source.

Furthermore, the operation of determining the minimum color light source among the first color light source, the second color light source, and the third color light source, and obtaining the light source adjustment coefficient corresponding to the minimum color light source based on the first saturation signal and the second saturation signal may include: determining the maximum color light source, the middle color light source, and the minimum color light source among the first color light source, the second color light source, and the third color light source; obtaining the light source adjustment coefficient corresponding to the maximum color light source, the light source adjustment coefficient corresponding to the minimum color light source and the light source adjustment coefficient corresponding to the middle color light source, based on the first saturation signal and the second saturation signal.

The operation of adjusting the minimum color light source using light source adjustment coefficient to obtain the fourth brightness value, and driving the minimum color light source using the fourth brightness value may include: adjusting the minimum color light source using the light source adjustment coefficient corresponding to the minimum color light source to obtain the fourth brightness value, and adjusting the middle color light source using the light source adjustment coefficient corresponding to the middle color light source to obtain a fifth brightness value; adjusting the maximum color light source using the light source adjustment coefficient corresponding to the maximum color light source to obtain a sixth brightness value; driving the minimum color light source using the fourth brightness value; driving the middle color light source using the fifth brightness value; and driving the maximum color light source using the sixth brightness value.

That is, this application uses the fourth brightness value to drive the minimum color light source, the fifth brightness value to drive the middle color light source, and the sixth brightness value to drive the maximum color light source, so that all the minimum color light source, the middle color light source and the maximum color light source can enhance the corresponding under-displayed hues to make them return to the original saturated color points, thereby maintaining the color purity of the hues corresponding to the minimum color light source, the middle color light source, and the maximum color light source.

The operation of determining the minimum color light source among the first color light source, the second color light source, and the third color light source, and obtaining the light source adjustment coefficient corresponding to the minimum color light source based on the first saturation signal and the second saturation signal may include:

obtaining the first brightness normalized signals corresponding to the first saturation signal, and separately calculating the first maximum signal, the first middle signal, and the first minimum signal among an average signal of the first red brightness normalized signal, an average signal of the first green brightness normalized signal, and an average signal of the first blue brightness normalized signal;

obtaining the second brightness normalized signals corresponding to the second saturation signal, and separately calculating the second maximum signal, the second middle signal, and the second minimum signal among an average signal of the second red brightness normalized signal, an average signal of the second green brightness normalized signal, and an average signal of the second blue brightness normalized signal;

obtaining the first light source adjustment coefficient corresponding to the minimum color light source based on the first minimum signal and the second minimum signal;

obtaining the second light source adjustment coefficient corresponding to the middle color light source based on the first middle signal and the second middle signal;

where the backlight module is a direct-lit backlight, which includes multiple backlight subareas, and each backlight subarea includes a red light source, a green light source, and a blue light source that are independent of each other;

the first brightness normalized signals include a first red brightness normalized signal, a first green brightness normalized signal, and a first blue brightness normalized signal;

the second brightness normalized signals include a second red brightness normalized signal, a second green brightness normalized signal, and a second blue brightness normalized signal;

Through a comparison between the first maximum signal, the first middle signal, and the first minimum signal in the average signals of the red, green, and blue hues corresponding to the first saturation signal, and the second maximum signal, the second middle signal, and the second minimum signal in the average signals of the red, green, and blue hues corresponding to the second saturation signal (obtained by adjusting the first saturation signal), the first light source adjustment coefficient and the second light source adjustment coefficient are obtained to realize the targeted adjustments of the light sources, so that the light sources can accurately increase the light intensity of the light source according to the amplitudes of the drops of the first minimum signal and the first middle signal, so as to achieve the goal of balance even after adjusting the color saturation. With the aid of the light source, the color point can return to the original saturated color point, thereby reducing the color shift of the display panel while maintaining the color purity performance.

The first maximum signal maxn_ave, the first middle signal midn_ave, the first minimum signal minn_ave, the average signal rn_ave of the first red brightness normalized signal, the average signal gn_ave of the first green brightness normalized signal, and the average signal bn_ave of the first blue brightness normalized signal satisfy the following formulas: maxn_ave=Max(rn_ave, gn_ave, bn_ave); midn_ave=Mid(rn_ave, gn_ave, bn_ave); and minn_ave=Min(rn_ave, gn_ave, bn_ave).

The second maximum signal max'n_ave, the second middle signal mid'n_ave, the second minimum signal min'n_ave, the average signal r'n_ave of the second red brightness normalized signal, the second green brightness normalized signal, and the average signal b'n_ave of the second blue brightness normalized signal satisfy the following formulas: max'n_ave=Max(r'n_ave, g'n_ave, b'n_ave); mid'n_ave=Mid(r'n_ave, g'n_ave, b'n_ave); min'n_ave=Min(r'n_ave, g'n_ave, b'n_ave). The first maximum signal maxn_ave, the first middle signal midn_ave, the first minimum signal mimn_ave, the second maximum signal max'n_ave, the second middle signal mid'n_ave, and the second minimum signal min'n_ave in this application are all obtained by calculation, which improves the accuracy of light source adjustment in this application.

Figure 10:
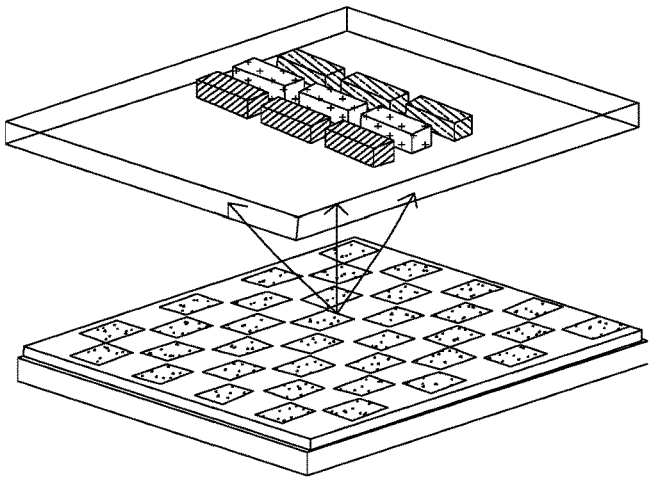
FIG. 10 is a schematic diagram of a direct lit display assembly according to an embodiment of this application.

FIG. 10 is a schematic diagram of a direct-lit display assembly according to an embodiment of the present application. As illustrated in FIG. 10, the first red brightness normalized signals corresponding to the backlight subarea are: rn_1,1, rn_1,2, . . . , rn_i,j. The first green brightness normalized signals corresponding to the backlight subarea are: gn_1,1, gn_1,2, . . . , gn_i,j. The first blue brightness normalized signals corresponding to the backlight subarea are: bn_1,1, bn_1,2, . . . , bn_i,j. The average signal rn_ave of the first red brightness normalized signals, the average signal gn_ave of the first green brightness normalized signals, and the average signal bn_ave of the first blue brightness normalized signals satisfy the following formulas:

$$rn_ave=\text{Average}(rn_1,1,rn_1,2, \ldots ,rn_i,j);$$

$$gn_ave=\text{Average}(gn_1,1,gn_1,2, \ldots ,gn_i,j); \text{ and}$$

$$bn_ave=\text{Average}(bn_1,1,bn_1,2, \ldots ,bn_i,j).$$

The second red brightness normalized signals corresponding to the backlight subarea are: r'n_1,1, r'n_1,2, . . . , r'n_i,j. The second green brightness normalized signals corresponding to the backlight subarea are g'n_1,1, g'n_1,2, . . . , g'n_i,j. The second blue brightness normalized signals corresponding to the backlight subarea are b'n_1,1, b'n_1,2, . . . , b' n_i,j. The average signal r'n_ave of the second red brightness normalized signals, the average signal g'n_ave of the second green brightness normalized signals, and the average signal b'n_ave of the second blue brightness normalized signals satisfy the following formulas:

$$r'n_ave=\text{Average}(r'n_1,1,r'n_1,2, \ldots ,r'n_i,j);$$

$$g'n_ave=\text{Average}(g'n_1,1,g'n_1,2, \ldots ,g'n_i,j); \text{ and}$$

$$b'n_ave=\text{Average}(b'n_1,1,b'n_1,2, \ldots ,b'n_i,j).$$

By calculating the red, green, and blue brightness normalized signals before and after each adjustment, the average signal of the first red brightness normalized signals, the average signal of the first green brightness normalized signals, the average signal of the first blue brightness normalized signals, the average signal of the second red brightness normalized signals, the average signal of the second green brightness normalized signals, and the average signal of the second blue brightness normalized signals are obtained. The calculation method according to this solution takes into consideration the changes in the brightness normalized signals each pixel, so that the calculated construction is representative and accurate, which realizes accurate and efficient adjustment of the light source, making the light intensity displayed by the adjusted light source have a higher degree of consistency with the expectation.

In addition, for example, when the hue calculated by the first brightness normalized signal satisfies: $0<Hn_i,j<30$ (that is, red is the main hue), then the first middle brightness normalized signal and the first minimum brightness normalized signal would maintain the fixed brightness difference of $gn_i,j-bn_i,j=g'n_i,j-b'n_i,j$.

Assuming that the first light source adjustment coefficient is x and the second light source adjustment coefficient is y, the following formulas are satisfied: $midn_ave=x\times mid'n_ave$, $minn_ave=y\times min'n_ave$. Through the calculation according to the formulas, the signal change ratio is obtained, so that the ratio of the light source to be adjusted can be calculated correspondingly. In addition, the present application may also obtain the third light source adjustment coefficient corresponding to the maximum color light source based on the first maximum signal and the second maximum signal. Let the third light source adjustment coefficient be z, then the following formula is satisfied: $maxn_ave=x\times max'n_ave$.

During the driving process of the display panel, the operation of receiving the first color signal corresponding to the display panel, converting the first color signal into the first brightness normalized signals, and converting the first brightness normalized signals into the first HSV spatial signal may include the following. The input signal of the first color signal is an 8-bit grayscale digital signal of 0, 1, . . . 255, and the grayscale signals are input as first brightness normalized signals (grayscale of 255 is the maximum brightness) with respect to 255, which are r, g, b, respectively, $$r=(R/255)\hat{}\gamma r, g=(G/255)\hat{}\gamma g, b=(B/255)\hat{}\gamma b;$$

where γr, γg, and γb are gamma signals.

Figure 11:
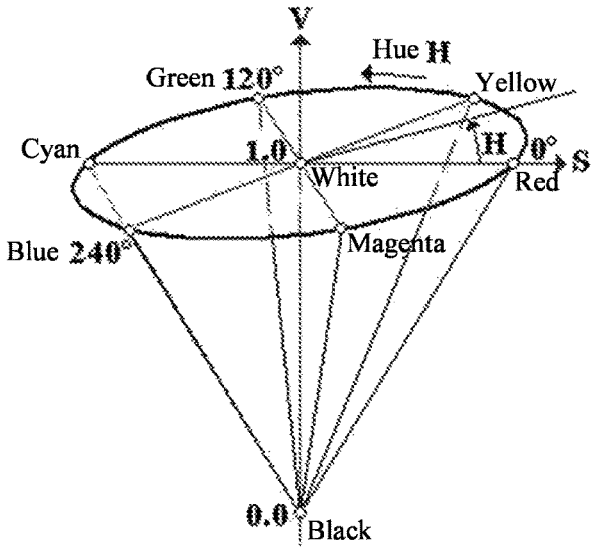
FIG. 11 is a schematic diagram illustrating a hue expression according to an embodiment of this application.

As illustrated in FIG. 11, H represents the color, representing different hue colors by 00 to 3600, where 00 is defined as red, 1200 is green, and 2400 is blue.

The formulas for converting the brightness normalized signals r, g, b into hue h and saturation signal s are as follows:

$$h=\begin{cases} 0^\circ & \text{if } \max=\min \\ 60^\circ\times\dfrac{g-b}{\max-\min}+0^\circ & \text{if } \max=r \text{ and } g\geq b \\ 60^\circ\times\dfrac{g-b}{\max-\min}+360^\circ & \text{if } \max=r \text{ and } g<b \\ 60^\circ\times\dfrac{b-r}{\max-\min}+120^\circ & \text{if } \max=g \\ 60^\circ\times\dfrac{r-g}{\max-\min}+240^\circ & \text{if } \max=b \end{cases}$$

$$s=\begin{cases} 0^\circ & \text{if } \max=0 \\ 1-\dfrac{\min}{\max} & \text{otherwise} \end{cases}$$

where max represents the maximum value in r/g/b, and min represents the minimum value in r/g/b.

Figure 12:
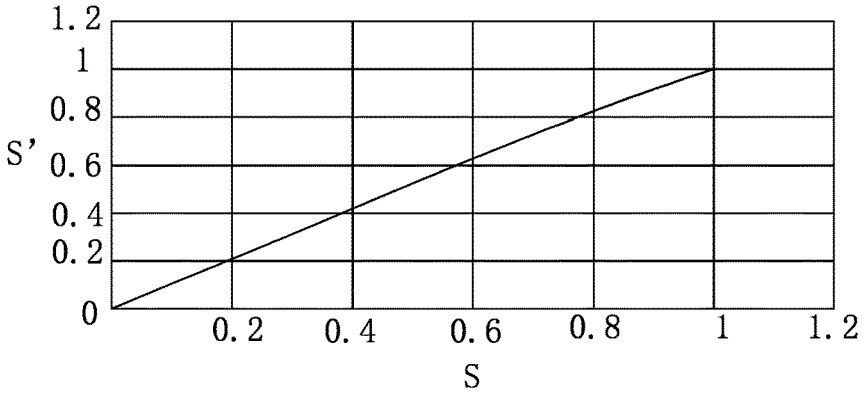
FIG. 12 is a schematic diagram illustrating the changes of a saturation signal and a second saturation signal according to an embodiment of this application.

FIG. 12 is a schematic diagram illustrating the variation of the saturation signal and the second saturation signal. As illustrated in FIG. 12, the operation of adjusting the first saturation signal Sn_i,j of the first HSV spatial signal using the preset adjustment coefficient to obtain the second saturation signal S'n_i,j may include: obtaining the second saturation signal S'n_i,j from the first saturation signal Sn_i,j using the following formula:

$$S'n_i,j=a\times S^4n_i,j+b\times S^3n_i,j+c\times S^2n_i,j+d\times Sn_i,j+e;$$

where a, b, c, d, e are preset adjustment coefficients, which are constants and can be adjusted according to actual needs.

The operation of converting the second saturation signal into the second color signal may include: converting the second saturation signal to obtain a second HSV spatial signal, and turning down the minimum value of the brightness normalized signals according to the second HSV spatial signal to obtain second brightness normalized signals; and converting the second brightness normalized signals to obtain the second color signal.

Figure 13:
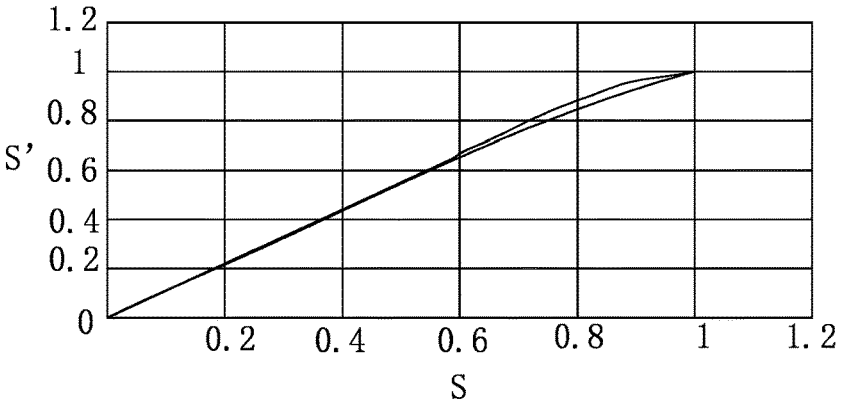
FIG. 13 is a schematic diagram illustrating the changes of a saturation signal and a second saturation signal according to another embodiment of this application.

In one embodiment, the present application may also divide the hue H into a number of m hue intervals. FIG. 13 is a schematic diagram illustrating the variation of the saturation signal and the second saturation signal according to this embodiment. As illustrated in FIG. 13, the preset adjustment coefficients a(H(m)), b(H(m)), c(H(m)), d(H(m)), e(H(m)) may be obtained depending on the hue interval, where the more significant the color shift, the greater the adjustment coefficients. The saturation signal s and the saturation signal S'(H(m), S) corresponding to the hue interval may satisfy the following formula:

$$S'(H(m),S)=a(H(m))\times S^4+b(H(m))\times S^3+c(H(m))\times S^2+d(H(m))\times S+e(H(m))$$

where a(H(m)), b(H(m)), c(H(m)), d(H(m)), e(H(m)) are saturation adjustment constants of the corresponding hue interval.

After the hue (H) is divided into multiple intervals, because different intervals have different degrees of color shift, different adjustments to the saturation can be made according to different intervals, which can increase the color vividness of the display panel, and make adjustment of the color shift more even.

The operation of converting the second saturation signal into the second color signal may include: converting the second saturation signal S'n_i,j to obtain second brightness normalized signals, and converting the second brightness normalized signals r', g', b' using the following formulas to obtain the second color signal R', G', B':

$$R'=255\times(r')^{1/\gamma r}, G'=255\times(g')^{1/\gamma g}, B'=255\times(b')^{1/\gamma b}.$$

While using the second three primary colors of red, green, and blue to drive the display panel, the fourth brightness value is used to drive the minimum color light source, and the fifth brightness value is used to drive the middle color light source.

Figure 14:
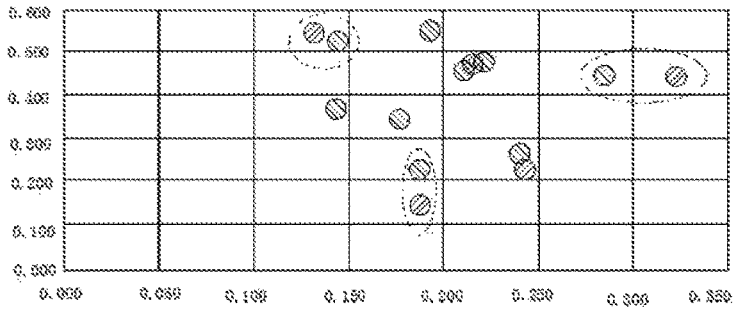
FIG. 14 is a schematic diagram illustrating the changes in the color difference between a saturation signal and a second saturation signal according to an embodiment of this application.
Figure 15:
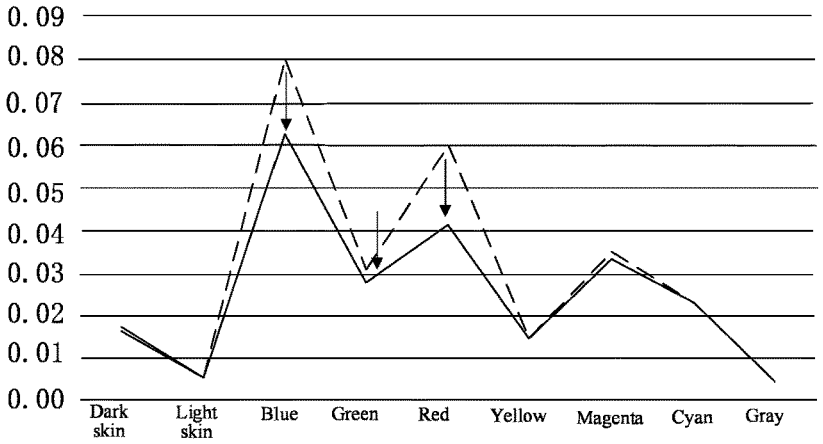
FIG. 15 is a schematic diagram illustrating the changes in the color difference of different colors of the saturation signal and the second saturation signal according to another embodiment of this application.

FIG. 14 is a schematic diagram illustrating the change of the color difference between the saturation signal and the second saturation signal. FIG. 15 is a schematic diagram illustrating the change of the color difference between the saturation signal and the second saturation signal of different colors. As can be seen from above, the color mixing components are reduced, and the color purity of the main hue is increased, thereby improving the color purity of the signal, which is beneficial to improve the color shift. In particular, taking red as an example, when the hue is close to the pure red hue, significant color shift degradation may be seen at viewing angles. Accordingly, the brightness normalized signal of the color with the minimum brightness normalized signal in the red pure hue can be reduced to achieve the purpose of increasing the saturation of the main hue in the red pure hue. This reduces the mixing of other colors (green and blue) in the hues with red as the main hue, making the leaking color at large viewing angles close to the original color seen at the front view, thus solving the problem color shift between front and side views.

In addition, also taking red as an example, where red is the main hue in the pure red hue, this application may also increase the minimum brightness normalized signal in the brightness normalized signals of other colors in the red pure hue, thereby reducing the saturation of hue with red as the main hue. This will make the mixed color close to the white neutral color, and the main reason that the color shift of the neutral color will be reduced is because the three primary colors of red, green, and blue are all allowed to leak, so that the mixture of the leaked colors of the three primary colors will not produce a color, that is, the colors of leaked light at the front and side views are a neutral color.

Figure 16:
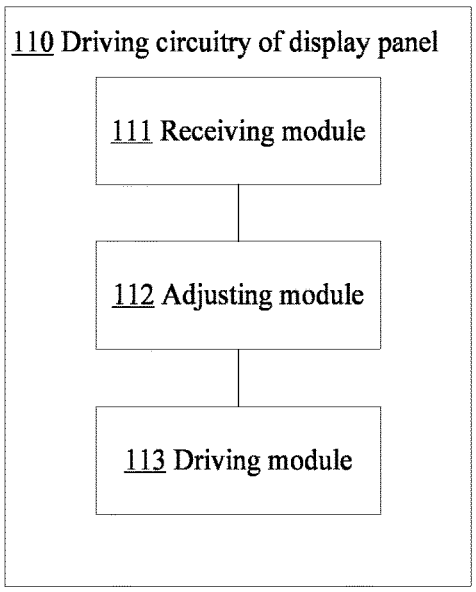
FIG. 16 is a block diagram of a driving circuitry of a display panel according to another embodiment of this application.
Figure 17:
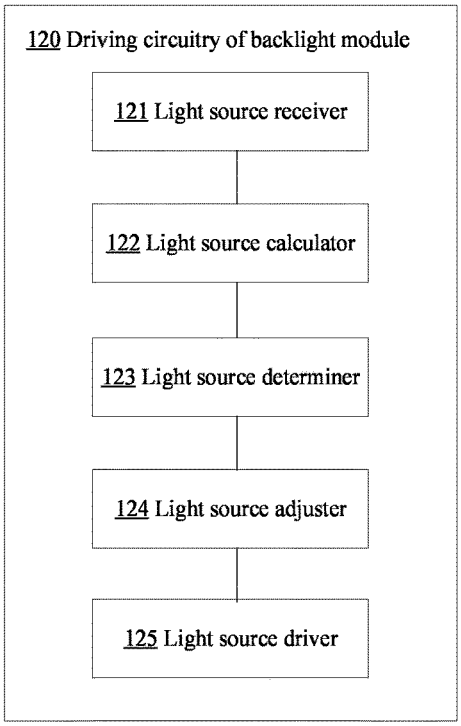
FIG. 17 is a block diagram of a driving circuitry of a backlight module according to another embodiment of this application.

As another embodiment of the present application, as illustrated in FIG. 5, FIG. 16, and FIG. 17, the present application further discloses a driving system 100 for a display assembly, which uses the following display assembly driving method, the driving system 100 including a drive circuitry 110 configured to drive the display panel, and a drive circuitry 120 configured to drive the backlight module, where the display panel and the backlight module are synchronously driven. The backlight module includes at least one backlight subarea, and each backlight subarea includes a first color light source, a second color light source, and a third color light source that are independently controlled. The corresponding light source brightness of the first color light source is a first brightness value, the corresponding light source brightness of the second color light source is a second brightness value, and the corresponding light source brightness of the third color light source is a third brightness value.

The driving circuitry 110 of the display panel includes a receiver 111, an adjuster 112, and a driver 113. The receiver 111 receives a first color signal corresponding to the display panel, converts the first color signal into first brightness normalized signals, and converts the first brightness normalized signals into a first HSV (hue, saturation, value) signal. The adjuster 112 adjusts a first saturation signal of the first HSV spatial signal using a preset adjustment coefficient to obtain a second saturation signal with improved color shift and second brightness normalized signals corresponding to the second saturation signal. The converter 113 converts the second brightness normalized signals into the second color signal, and uses the second color signal to drive the display panel.

The driving circuitry 120 of the backlight module includes a light source receiver 121, a light source calculator 122, a light source determiner 123, a light source adjuster 124, and a light source driver 125. The light source receiver 121 receives the first color signal corresponding to the display panel, and calculates the first saturation signals and the second saturation signals corresponding to all pixels in this backlight subarea. The light source calculator 122 separately calculates an average signal of all the first saturation signals and an average signal of the second saturation signals corresponding to this backlight subarea. The light source determiner 123 determines the minimum color light source among the first color light source, the second color light source, and the third color light source, and obtains a minimum light source adjustment coefficient corresponding to the minimum color light source based on the average signal of the first saturation signals and the average signal of the second saturation signals. The light source adjuster 124 uses the minimum light source adjustment coefficient to adjust the minimum color light source to obtain a fourth brightness value. And the light source driver 125 uses the fourth brightness value to drive the minimum color light source.

The light source adjuster includes a first light source adjuster and a second light source adjuster. The first light source adjuster determines the above-mentioned minimum light source and obtains the minimum light source adjustment coefficient. The second light source adjuster determines the minimum color light source among the first color light source, the second color light source, and the third color light source, and obtains the middle light source adjustment coefficient corresponding to the middle color light source based on the first brightness normalized signals and the second brightness normalized signals. The light source driver may include a first light source driver and a second light source driver. The first light source driver uses the minimum light source adjustment coefficient to adjust the minimum color light source to obtain a fourth brightness value, and uses the fourth brightness value to drive the minimum color light source. The second light source driver uses the middle light source adjustment coefficient to adjust the middle color light source to obtain a fifth brightness value, and uses the fifth brightness value to drive the middle color light source.

Figure 18:
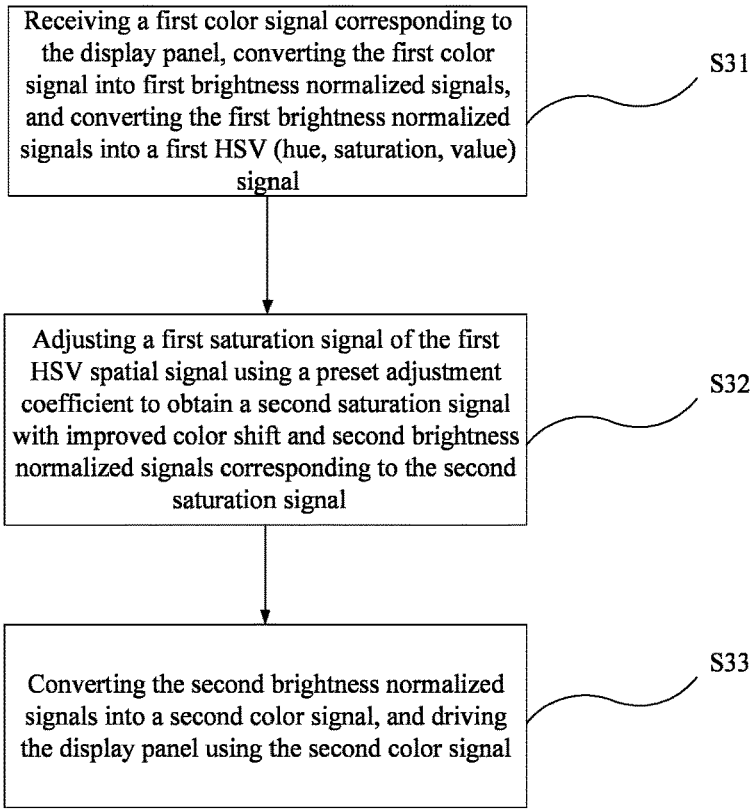
FIG. 18 is a flowchart illustrating a driving method of a display assembly according to another embodiment of this application.
Figure 19:
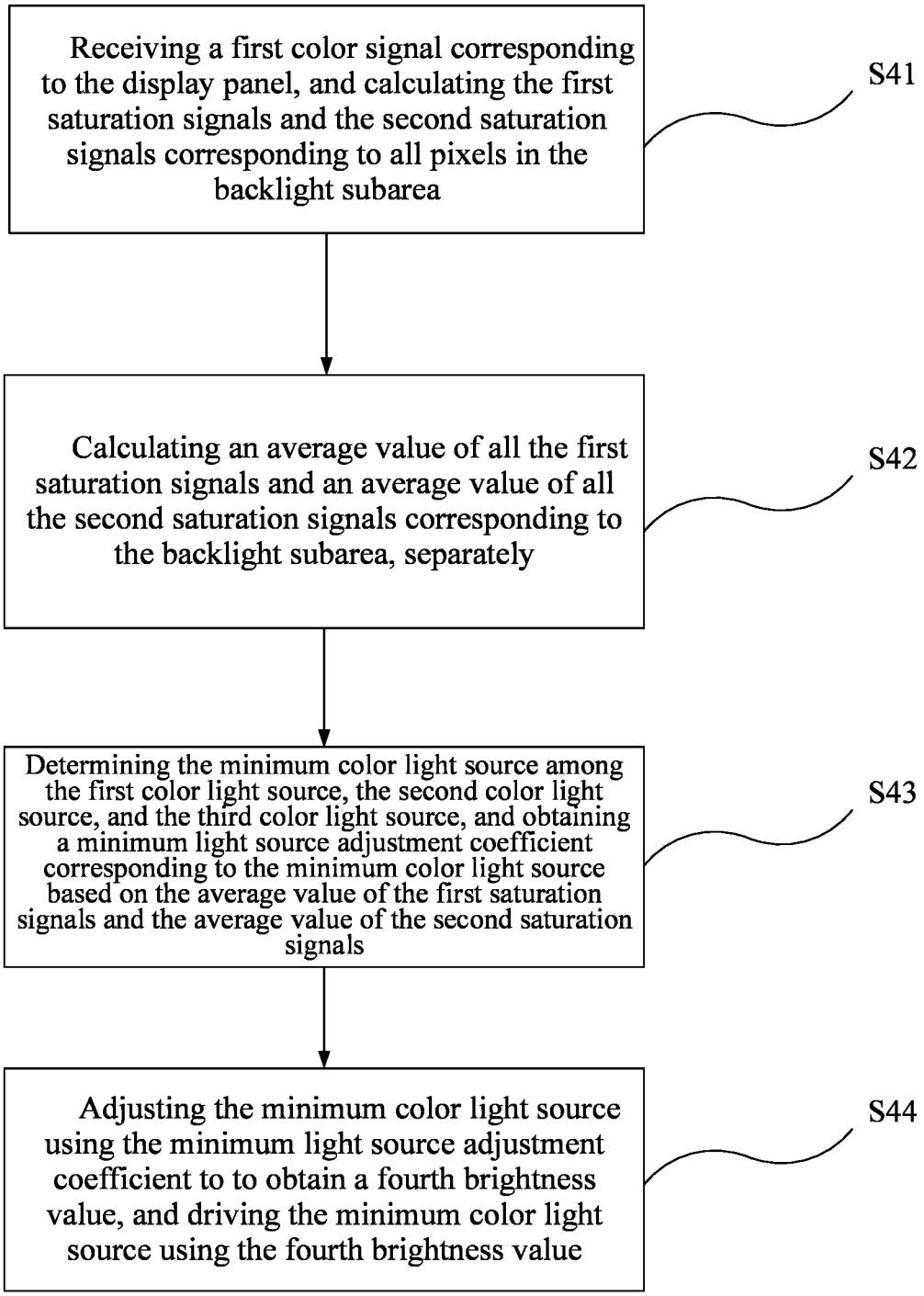
FIG. 19 is a flowchart illustrating a driving method of a display assembly according to yet another embodiment of this application.

Correspondingly, as illustrated in FIG. 18 and FIG. 19, the present application further discloses a driving method of a display assembly, the driving a driving process of a display panel and a driving process of a backlight module that are synchronously performed.

The backlight module includes at least one backlight subarea, and each backlight subarea includes a first color light source, a second color light source, and a third color light source that are independently controlled. The corresponding light source brightness of the first color light source is a first brightness value, the corresponding light source brightness of the second color light source is a second brightness value, and the corresponding light source brightness of the third color light source is a third brightness value.

The driving process of the display panel includes the following operations:

S31: receiving a first color signal corresponding to the display panel, converting the first color signal into first brightness normalized signals, and converting the first brightness normalized signals into a first HSV (hue, saturation, value) signal;

S32: adjusting a first saturation signal of the first HSV spatial signal using a preset adjustment coefficient to obtain a second saturation signal with an improved color shift and second brightness normalized signals corresponding to the second saturation signal;

S33: converting the second saturation signal into a second color signal and driving the display panel using the second color signal; and The driving process of the backlight module includes the following operations:

S41: receiving the first color signal corresponding to the display panel, and calculating all the first saturation signals and the second saturation signals corresponding to the backlight subarea;

S42: separately calculating an average signal of all the first saturation signals and an average signal of all the second saturation signals corresponding to this backlight subarea;

S43: determining a minimum color light source among the first color light source, the second color light source, and the third color light source, and obtaining a minimum light source adjustment coefficient corresponding to the minimum color light source based on the average value of the first saturation signal and the average value of the second saturation signal; and S44: adjusting the minimum color light source using the minimum light source adjustment coefficient to obtain a fourth brightness value, and driving the minimum color light source using the fourth brightness value.

Compared with the solution of dividing a pixel of the display panel into a main pixel and a sub-pixel to mitigate the color shift problem, an exemplary technique includes adjusting the first saturation to obtain a second saturation, converting the second saturation into a second color signal, and driving the display panel using the second color signal, which can well improve the color shift problem. However, due to the adjustment of the saturation value, the image quality and the saturation will be lacking. This application obtains the minimum light source adjustment coefficient based on the average value of the first saturation signal and the average value of the second saturation signal to adjust the brightness of the minimum color light source. Herein, the adjustment of the light source intensity takes an individual backlight subarea as a unit, which improves the hues which have undergone loss of color saturation, and may, in conjunction with the adjusted light source intensity, enable the adjusted color saturation return to the original saturation, thereby maintaining the color purity performance while reducing the viewing angle color shift. In the above description, the color signals may be RGB three-primary-color signals. In particular, the first color signal may be a RGB three-primary-color signal, and the second color signal may be a second RGB three-primary-color signal.

The operation of obtaining the minimum light source adjustment coefficient corresponding to the minimum color light source based on the average signal of the first saturation signal and the average signal of the second saturation signal may include the following. In particular, the minimum light source adjustment coefficient y may satisfy the following formula: y=(Sn_ave−1)/(S'n_ave−1), where Sn_ave is the average signal of the first saturation signal, and S'n_ave is the average signal of the second saturation signal. In this formula, the difference between the average signal of the adjusted first saturation signal and the average signal of the second saturation signal is calculated based on the average signal of the first saturation signal and the average signal of the second saturation signal, taking the backlight subarea as a unit. Then the value of the minimum light source adjustment coefficient based is calculated on this, and the minimum color light source is adjusted as a whole according to the minimum light source adjustment coefficient such calculated. Thus, by controlling the light source intensity of the minimum color light source, the adjusted light source intensity may be combined with the second saturation signal corresponding to the minimum color light source to show the color displayed by the first saturation signal, thereby improving or even maintaining the vividness and brilliance of the colors while improving the color shift.

The first brightness normalized signals include a first red brightness normalized signal rn_i,j, a first green brightness normalized signal gn_i,j, and a first blue brightness normalized signal bn_i,j; the second brightness normalized signals include a second red brightness normalized signals r'n_i,j, a second green brightness normalized signal g'n_i,j, and a second blue brightness normalized signal b'n_i,j.

The operation of adjusting the first saturation signal of the first HSV spatial signal using the preset adjustment coefficient to obtain the second saturation signal and the second brightness normalized signals corresponding to the second saturation signal may include: adjusting the first saturation signal Sn_i,j to obtain the second saturation signal S'n_i,j according to the following formula: $S'n_i,j=a\times S^4n_i,j+b\times S^3n_i,j+c\times S^2n_i,j+d\times Sn_i,j+e$, where a, b, c, d, e are preset adjustment coefficients and are constants; adjusting the minimum value in the first brightness normalized signals based on the first saturation signal Sn_i,j and the second saturation signal S'n_i,j to obtain the second brightness normalized signals, in particular, by the following formula.

According to Sn_i,j=1−minn_i,j/maxn_i,j, keep maxn_i,j unchanged, and only reduce minn_i,j to obtain the second saturation signal Sn_i,j'=1−min'n_i,j/maxn_i,j, and the minimum value min'n_i,j in the second brightness normalized signals, where maxn_i,j=Max(rn_i,j, gn_i,j, bn_i,j)=Max(r'n_i,j, g'n_i,j, b'n_i,j); mid i,j=Mid(rn_i,j, gn_i,j, bn_i,j); minn_i,j=Min(rn_i,j, gn_i,j, bn_i,j); mid'n_i,j=Mid(r'n_i,j, g'n_i,j, b'n_i,j); min'n_i,j=Min(r'n_i,j, g'n_i,j, b'n_i,j). The operation of separately calculating the average signal of all the first saturation signals and the average signal of all the second saturation signals corresponding to the backlight subarea may include: calculating the average value of all the first saturation signals in the backlight subarea by Sn_ave=Average (Sn_1, 1, Sn_1,2, . . . , Sn_i,j); and calculating the average value of all the second saturation signals in the backlight subarea by S'n_ave=Average(S'n_1,1, S'n_1,2, . . . , S'n_i,j).

By reducing the minimum value minn_i,j in each first brightness normalized signal, the second brightness normalized signal is obtained, which reduces the components of colors other than the main color, that is, reduces the color mixing, thereby effectively improving the color shift issue. By reducing the minimum value minn_i,j to increase the color saturation, namely removing the other colors in the mixed color, only the main color is retained, so that the color leaking at the large viewing angle would be close to the front-view original color, and so the problem of color shift from the front view to the side views can also be solved. That is, the leaking color at the front view and side views are one of the three primary colors.

In addition, the preset adjustment coefficient in the formula for converting the first saturation signal into the second saturation signal may also be changed according to the actual situation. For example, it is also possible to reduce the saturation by increasing minn_i,j, when needed. In this case, the mixed color will be close to the white neutral color. The main reason for the drop of the color shift of the neutral color is because all the three primary colors of RGB are allowed to leak, so that the leaking colors of the three primary colors when mixed will not produce color, that is, the leaking color at the front view and the side views is a neutral color.

After adjusting the minimum color light source by using the minimum light source adjustment coefficient, the third saturation signal corresponding to all the pixels of the backlight subarea and an third saturation average value is calculated. The operation of obtaining the minimum light source adjustment coefficient corresponding to the minimum color light source based on the average signal of the first saturation signal and the average signal of the second saturation signal may include: obtaining the minimum light source adjustment coefficient y in order that the third color saturation average value S"n_ave obtained after the minimum color light source is adjusted using the average signal S'n_ave of the second saturation signal corresponding to the backlight subarea may satisfy the following formula: S"n_ave=Sn_ave. According to the following three formulas: S"n_ave=1−min'*y/maxn_ave; S'n_ave=1−min'/maxn_ave Sn_ave=1−minn_ave/maxn_ave; we get: y=(Sn_ave−1)/(S'n_ave−1).

where minn_ave is the actual first minimum average value among the average value of the first red brightness normalized signals, the average value of the first green brightness normalized signals, and the average value of the first blue brightness normalized signals of the backlight subarea, maxn_ave is the first maximum average value among the average value of the second red brightness normalized signals, the average value of the second green brightness normalized signals, and the average value of the second blue brightness normalized signals of the backlight subarea, and min' is the minimum signal among the average values of the second brightness normalized signals calculated by assuming that maxn_ave is unchanged.

After adjusting the first saturation signal to obtain the second saturation signal, the minimum light source intensity corresponding to the second saturation signal is then adjusted, to obtain the display of the color performance of the third saturation signal. The minimum light source adjustment coefficient is y, and the average signal of the adjusted third saturation signal is equal to the average signal of the first saturation signal, so that the color performance level of the third saturation signal is consistent with the color performance level of the first saturation signal, thereby maintaining the color performance while improving the color shift.

The operation of determining the minimum color light source among the first color light source, the second color light source, and the third color light source, and obtaining the minimum color light source adjustment coefficient corresponding to the minimum color light source based on the average signal of the first saturation signal and the average signal of the second saturation signal may further include: determining the middle color light source among the first color light source, the second color light source, and the third color light source; obtaining the middle light source adjustment coefficient based on the first brightness normalized signals and the second brightness normalized signals. The operation of using the minimum light source adjustment coefficient to adjust the minimum color light source to obtain the fourth brightness value, and using the fourth brightness value to drive the minimum color light source may further include: using the middle light source adjustment coefficient to adjust the middle color light source to obtain the fifth brightness value, and using the fifth brightness value to drive the middle color light source.

The first brightness normalized signals include a first red brightness normalized signal, a first green brightness normalized signal, and a first blue brightness normalized signal. The second brightness normalized signals include a second red brightness normalized signal, a second green brightness normalized signal, and a second blue brightness normalized signal. In each backlight subarea, the second maximum average value, the second middle average value, and the second minimum average value among the average value of the second red brightness normalized signals, the average value of the second green brightness normalized signals, and the average value of the second blue brightness normalized signals are calculated. The operation of obtaining the middle light source adjustment coefficient based on the first brightness normalized signals and the second brightness normalized signals may include the following. In particular, let the middle light source adjustment coefficient be x, which satisfies the following formula: midn_ave=x*mid'n_ave; where midn_ave is the first middle average value, and mid'n_ave is the second middle average value.

By adjusting the light source intensity corresponding to the middle signal, it is possible to reduce the contrast of the mixed color components when adjusting from the first saturation signal to the second saturation signal, thereby reducing the hue deviation issue which may be produced in the saturation adjustment step, so that after adjusting the light source, the hue of the picture can approach or even return to the hue of the first HSV spatial signal, that is, H"n_ave=Hn_ave, where Hn_ave is the average value of the hue in the first color space signal, and H"n_ave is the average value of the hue displayed after the middle light source is adjusted by the middle light source adjustment coefficient x. In other words, the accuracy of the overall hue is maintained before and after the adjustment.

In addition, the operation of obtaining the second saturation signal S'n_i,j=1−min'n_i,j/maxn_i,j, and the minimum value min'n_i,j in the second brightness normalized signals according to Sn_i,j=1−minn_i,j/maxn_i,j, by keeping maxn_i,j unchanged and only reducing minn_i,j may further include:

according to midn_i,j−minn_i,j=mid'n_i,j−min'n_i,j, calculating the middle value mid−min=mid'−min' in the second brightness normalized signals.

For example, when it is calculated from the brightness normalized signals r, g, b that the hue satisfies 0<Hn_i,j<30, then the second-maximum brightness signal minus the minimum brightness signal gn_i,j−bn_i,j=g'n_i,j−b'n_i,j would maintain a fixed brightness difference. In addition, the original normalized brightness signals are converted to the saturation signal Sn_i,j=1-bn_i,j/rn_i,j, and Sn_i,j is changed to S'n_i,j. After the conversion, the saturation S'n_i,j=1−b'n_i,j/rn_i,j can be used to calculate the minimum signal b'n_i,j in the second brightness normalized signals, and so middle signal g'n_i,j in the second brightness normalized signals can be calculated. This solution maintains the brightness difference between the second-maximum brightness signal and the minimum brightness signal before and after the adjustment, which is combined with the above-mentioned solution of using the middle light source adjustment coefficient to adjust the middle color light source, where the middle light source adjustment coefficient x satisfies midn_ave=x*mid'n_ave. Accordingly, this further improves the hue deviation caused in the saturation adjustment stage, serving the function of correcting the hue.

The relationships between the first maximum average value maxn_ave, the first middle average value midn_ave, the first minimum average value minn_ave, the average value rn_ave of the first red brightness normalized signals, the average value gn_ave of the first green brightness normalized signals, and the average value bn_ave of the first blue brightness normalized signals may satisfy the following formulas:

$$\max n_ave = \mathrm{Max}(rn_ave, gn_ave, bn_ave);$$

$$\mathrm{mid}n_ave = \mathrm{Mid}(rn_ave, gn_ave, bn_ave);$$

$$\min n_ave = \mathrm{Min}(rn_ave, gn_ave, bn_ave);$$

The relationships between the second maximum average value max'n_ave, the second middle average value mid- 'n_ave, the second minimum average value min'n_ave, the average value r'n_ave of the second red brightness normalized signals, the average value g'n_ave of the second green brightness normalized signals, and the average value b'n_ave of the second blue brightness normalized signals may satisfy the following formulas:

$$\max'n_ave=\mathrm{Max}(r'n_ave,g'n_ave,b'n_ave);$$

$$\mathrm{mid}'n_ave=\mathrm{Mid}(r'n_ave,g'n_ave,b'n_ave);$$

$$\min'n_ave=\mathrm{Min}(r'n_ave,g'n_ave,b'n_ave).$$

The first red brightness normalized signals corresponding to the backlight subarea are: rn_1,1, rn_1,2, . . . , rn_i,j. The first green brightness normalized signals corresponding to the backlight subarea are: gn_1,1, gn_1,2, . . . , gn_i,j. The first blue brightness normalized signals corresponding to the backlight subarea are: bn_1,1, bn_1,2, . . . , bn_i,j. The average value rn_ave of the first red brightness normalized signals, the average value gn_ave of the first green brightness normalized signals, and the average value bn_ave of the first blue brightness normalized signals satisfy the following formulas:

$$rn_ave=\mathrm{Average}(rn_1,1,rn_1,2,\ldots,rn_i,j);$$

$$gn_ave=\mathrm{Average}(gn_1,1,gn_1,2,\ldots,gn_i,j);\text{ and}$$

$$bn_ave=\mathrm{Average}(bn_1,1,bn_1,2,\ldots,bn_i,j);$$

The second red brightness normalized signals corresponding to the backlight subarea are: r'n_1,1, r'n_1,2, . . . , r'n_i,j. The second green brightness normalized signals corresponding to the backlight subarea are g'n_1,1, g'n_1,2, . . . , g'n_i,j. The second blue brightness normalized signals corresponding to the backlight subarea are b'n_1,1, b'n_1,2, . . . , b' n_i,j. The average value r'n_ave of the second red brightness normalized signals, the average value g'n_ave of the second green brightness normalized signals, and the average value b'n_ave of the second blue brightness normalized signals may satisfy the following formulas:

$$r'n_ave=\mathrm{Average}(r'n_1,1,r'n_1,2,\ldots,r'n_i,j);$$

$$g'n_ave=\mathrm{Average}(g'n_1,1,g'n_1,2,\ldots,g'n_i,j);$$

$$b'n_ave=\mathrm{Average}(b'n_1,1,b'n_1,2,\ldots,b'n_i,j).$$

This application obtains the average value of the first red brightness normalized signals, the average value of the first green brightness normalized signals, the average value of the first blue brightness normalized signals, the average value of the second red brightness normalized signals, the average value of the second green brightness normalized signals, and the average value of the second blue brightness normalized signals through accurate calculations. Thus, it is accurate to the change of the brightness normalized signals corresponding to each pixel, so that the results obtained according to the precise calculations are also more accurate, leading to a better adjustment effect.

FIG. 10 is a schematic diagram of a direct-lit display assembly. As illustrated in FIG. 10, the display panel includes a plurality of backlight subareas, and each backlight subarea individually includes a first color light source, second color light source, and third color light source that are controlled in an independent manner, where the first color light source, the second color light source, and the third color light source are arranged corresponding to the pixels in the display area.

During the driving process of the display panel, the operation of receiving the first color signal corresponding to the display panel, converting the first color signal into the first brightness normalized signals, and converting the first brightness normalized signals into the first HSV spatial signal may include the following. The input signal of the first color signal is an 8-bit grayscale digital signal of 0, 1, . . . 255, and the grayscale signals are input as first brightness normalized signals (grayscale of 255 is the maximum brightness) with respect to 255, which are r, g, b, respectively, r=(R/255)^γr, g=(G/255)^γg, b=(B/255)^γb; where γr, γg, and γb are gamma signals.

As illustrated in FIG. 11, H represents the color, representing different hue colors by 00 to 3600, where 00 is defined as red, 1200 is green, and 2400 is blue.

The formulas for converting the brightness normalized signals r, g, b into hue h and saturation signal s are as follows:

$$h=\begin{cases}0^\circ & \text{if } \max=\min\\ 60^\circ\times\dfrac{g-b}{\max-\min}+0^\circ & \text{if } \max=r \text{ and } g\geq b\\ 60^\circ\times\dfrac{g-b}{\max-\min}+360^\circ & \text{if } \max=r \text{ and } g<b\\ 60^\circ\times\dfrac{b-r}{\max-\min}+120^\circ & \text{if } \max=g\\ 60^\circ\times\dfrac{r-g}{\max-\min}+240^\circ & \text{if } \max=b\end{cases}$$

$$s=\begin{cases}0^\circ & \text{if } \max=0\\ 1-\dfrac{\min}{\max} & \text{otherwise}\end{cases}$$

where max represents the maximum value in r/g/b, and min represents the minimum value in r/g/b.

FIG. 12 is a schematic diagram illustrating the variation of the saturation signal and the second saturation signal. As illustrated in FIG. 12, the operation of adjusting the first saturation signal Sn_i,j of the first HSV spatial signal using the preset adjustment coefficient to obtain the second saturation signal S'n_i,j may include: obtaining the second saturation signal S'n_i,j from the first saturation signal Sn_i,j using the following formula:

$$S'n_i,j=a\times S^4n_i,j+b\times S^3n_i,j+c\times S^2n_i,j+d\times Sn_i,j+e,$$

where a, b, c, d, e are preset adjustment coefficients, which are constants and can be adjusted according to actual needs.

The operation of converting the second saturation signal into the second color signal may include: converting the second saturation signal to obtain a second HSV spatial signal, and turning down the minimum value of the brightness normalized signals according to the second HSV spatial signal to obtain second brightness normalized signals; and converting the second brightness normalized signals to obtain the second color signal.

In one embodiment, the present application may also divide the hue H into a number of m hue intervals. FIG. 13 is a schematic diagram illustrating the variation of the saturation signal and the second saturation signal according to this embodiment. As illustrated in FIG. 13, the preset adjustment coefficients a(H(m)), b(H(m)), c(H(m)), d(H(m)), e(H(m)) may be obtained depending on the hue interval, where the more significant the color shift, the greater the adjustment coefficients. The saturation signal s and the saturation signal S'(H(m), S) corresponding to the hue interval may satisfy the following formula:

$$S'(H(m),S)=a(H(m))\times S^4+b(H(m))\times S^3+c(H(m))\times S^2+d(H(m))\times S+e(H(m));$$

where a(H(m)), b(H(m)), c(H(m)), d(H(m)), e(H(m)) are saturation adjustment constants of the corresponding hue interval.

After the hue (H) is divided into multiple intervals, because different intervals have different degrees of color shift, different adjustments to the saturation can be made according to different intervals, which can increase the color vividness of the display panel, and make adjustment of the color shift more even.

The operation of converting the second saturation signal into the second color signal may include: converting the second saturation signal S'n_i,j to obtain second brightness normalized signals, and converting the second brightness normalized signals r', g', b' using the following formulas to obtain the second color signal R', G', B':

$$R'=255\times(r')^{1/\gamma r},G'=255\times(g')^{1/\gamma g},B'=255\times(b')^{1/\gamma b}.$$

While using the second color signal to drive the display panel, the fourth brightness value is used to drive the minimum color light source, and the fifth brightness value is used to drive the middle color light source.

FIG. 14 is a schematic diagram illustrating the change of the color difference between the saturation signal and the second saturation signal. FIG. 15 is a schematic diagram illustrating the change of the color difference between the saturation signal and the second saturation signal of different colors. As can be seen from above, the color mixing components are reduced, and the color purity of the main hue is increased, thereby improving the color purity of the signal, which is beneficial to improve the color shift. In particular, taking red as an example, when the hue is close to the pure red hue, significant color shift degradation may be seen at viewing angles. Accordingly, the brightness normalized signal of the color with the minimum brightness normalized signal in the red pure hue can be reduced to achieve the purpose of increasing the saturation of the main hue in the red pure hue. This reduces the mixing of other colors (green and blue) in the hues with red as the main hue, making the leaking color at large viewing angles close to the original color seen at the front view, thus solving the problem color shift between front and side views.

It should be noted that the various steps defined in this solution are not to be construed as limiting the order in which these steps are performed, on the premise of not affecting the implementation of the specific solution. In other words, the steps written earlier may be performed first, or may also be performed later, or may even be performed simultaneously. As long as the solution is able to be implemented, they variations shall all be regarded as falling in the scope of protection of this application.

The technical solutions of this application may be widely used in various display panels, such as TN (Twisted Nematic) display panels, IPS (In-Plane Switching) display panels, VA (Vertical Alignment) 1) Display panel, MVA (Multi-Domain Vertical Alignment) display panels. Of course, the above solutions may also be applicable to other types of display panels, such as OLED (Organic Light-Emitting Diode) display panels, The foregoing is merely a further detailed description of the present application in connection with some specific illustrative implementations, and it is to be construed as limiting the implementation of the present application to these implementations. For those having ordinary skill in the technical field to which this application pertains, numerous simple deductions or substitutions may be made without departing from the concept of this application, which shall all be regarded as falling in the scope of protection of this application.

What is claimed is:

1. A driving method of a display assembly, comprising a driving process of a display panel and a driving process of a backlight module that is synchronously driven with the display panel;

wherein the backlight module comprises a plurality of independently controlled light sources, comprising a first color light source, a second color light source, and a third color light source; a corresponding light source brightness of the first color light source is a first brightness value, a corresponding light source brightness of the second color light source is a second brightness value, and a corresponding light source brightness of the third color light source is a third brightness value;

wherein the driving process of the display panel comprises:

receiving a first color signal corresponding to the display panel, converting the first color signal into first brightness normalized signals, and converting the first brightness normalized signals into a first HSV (hue, saturation, value) signal;

adjusting a first saturation signal of the first HSV spatial signal using a preset adjustment coefficient to obtain a second saturation signal;

converting the second saturation signal into a second color signal; and driving the display panel using the second color signal;

wherein the driving process of the backlight module comprises:

receiving the first color signal corresponding to the display panel, and obtaining the first saturation signal and the second saturation signal;

determining a minimum color light source among the first color light source, the second color light source, and the third color light source, and obtaining a light source adjustment coefficient corresponding to the minimum color light source based on the first saturation signal and the second saturation signal; and adjusting the minimum color light source using the light source adjustment coefficient to obtain a fourth brightness value, and driving the minimum color light source using the fourth brightness value.

2. The driving method of claim 1, wherein the operation of adjusting the first saturation signal of the first HSV spatial signal using the preset adjustment coefficient to obtain the second saturation signal comprises:

obtaining the second saturation signal S'n_i,j from the first saturation signal Sn_i,j through the following formula:

$$S'n_i,j=a\times S^4n_i,j+b\times S^3n_i,j+c\times S^2n_i,j+d\times Sn_i,j+e;$$

where a, b, c, d, e are preset adjustment coefficients and are constants;

wherein the operation of converting the second saturation signal into the second color signal comprises: converting the second saturation signal to obtain a second HSV spatial signal, and reducing a minimum value of the brightness normalized signals according to the second HSV spatial signal to obtain second brightness normalized signals; and converting the second brightness normalized signals to obtain the second color signal.

3. The driving method of claim 1, wherein the operation of determining the minimum color light source among the first color light source, the second color light source, and the third color light source, and obtaining the light source adjustment coefficient corresponding to the minimum color light source based on the first saturation signal and the second saturation signal comprises:

determining a middle color light source and the minimum color light source among the first color light source, the second color light source, and the third color light source;

obtaining the light source adjustment coefficient corresponding to the minimum color light source and a light source adjustment coefficient corresponding to the middle color light source, based on the first saturation signal and the second saturation signal;

wherein the operation of adjusting the minimum color light source using the light source adjustment coefficient to obtain the fourth brightness value, and driving the minimum color light source using the fourth brightness value comprises:

adjusting the minimum color light source using the light source adjustment coefficient corresponding to the minimum color light source to obtain the fourth brightness value, and adjusting the light source adjustment coefficient corresponding to the middle color light source to obtain a fifth brightness value; and driving the minimum color light source using the fourth brightness value, and driving the middle color light source using the fifth brightness value.

4. The driving method of claim 3, wherein the backlight module is a direct-lit backlight, which comprises a plurality of backlight subareas, wherein each of the plurality of backlight subareas comprises a red light source, a green light source, and a blue light source that are independent of each other; wherein the operation of determining the minimum color light source among the first color light source, the second color light source, and the third color light source, and obtaining the light source adjustment coefficient corresponding to the minimum color light source based on the first saturation signal and the second saturation signal comprises:

obtaining the first brightness normalized signals corresponding to the first saturation signal, wherein the first brightness normalized signals comprise a first red brightness normalized signal, a first green brightness normalized signal, and a first blue brightness normalized signal; and calculating a first maximum signal, a first middle signal, and a first minimum signal among an average signal of the first red brightness normalized signal, an average signal of the first green brightness normalized signal, and an average signal of the first blue brightness normalized signal;

obtaining the second brightness normalized signals corresponding to the second saturation signal, wherein the second brightness normalized signals comprise a second red brightness normalized signal, a second green brightness normalized signal, and a second blue brightness normalized signal; and calculating a second maximum signal, a second middle signal, and a second minimum signal among an average signal of the second red brightness normalized signal, an average signal of the second green brightness normalized signal, and an average signal of the second blue brightness normalized signal;

obtaining a first light source adjustment coefficient corresponding to the minimum color light source based on the first minimum signal and the second minimum signal; and obtaining a second light source adjustment coefficient corresponding to the middle color light source based on the first middle signal and the second middle signal.

5. The driving, method of claim 4, wherein the first maximum signal maxn_ave, the first middle signal mid-n_ave, the first minimum signal minn_ave, the average signal rn_ave of the first red brightness normalized signal, the average signal gn_ave of the first green brightness normalized signal, and the average signal bn_ave of the first blue brightness normalized signal satisfy the following formulas:

$$\max n_\text{ave}=\text{Max}(rn_\text{ave},gn_\text{ave},bn_\text{ave});$$

$$\text{mid}n_\text{ave}=\text{Mid}(rn_\text{ave},gn_\text{ave},bn_\text{ave});$$

$$\min n_\text{ave}=\text{Min}(rn_\text{ave},gn_\text{ave},bn_\text{ave});$$

wherein the second maximum signal max'n_ave, the second middle signal mid'n_ave, the second minimum signal min'n_ave, the average signal r'n_ave of the second red brightness normalized signal, the average signal g'n_ave of the second green brightness normalized signal, and the average value b'n_ave of the second blue brightness normalized signal satisfy the following formulas:

$$\max' n_\text{ave}=\text{Max}(r'n_\text{ave},g'n_\text{ave},b'n_\text{ave});$$

$$\text{mid}' n_\text{ave}=\text{Mid}(r'n_\text{ave},g'n_\text{ave},b'n_\text{ave});$$

$$\min' n_\text{ave}=\text{Min}(r'n_\text{ave},g'n_\text{ave},b'n_\text{ave}).$$

6. The driving method of claim 5, wherein the first red brightness normalized signals corresponding, to the backlight subarea comprise rn_1,1, rn_1,2, . . . , m_i,j, the first green brightness normalized signals corresponding to the backlight subarea comprise gn_1,1, gn_1,2, . . . , gn_i,j, and the first blue brightness normalized signals corresponding to the backlight subarea comprise bn-1,1, bn_1,2, . . . , bn_i,j; wherein the average signal m_ave of the first red brightness normalized signals, the average signal gn_ave of the first green brightness normalized signals, and the average signal bn_ave of the first blue brightness normalized signals satisfy the following formulas:

$$rn_\text{ave}=\text{Average}(rn_1,1,rn_1,2,\ldots,rn_i,j);$$

$$gn_\text{ave}=\text{Average}(gn_1,1,gn_1,2,\ldots,gn_i,j);\text{ and}$$

$$bn_\text{ave}=\text{Average}(bn_1,1,bn_1,2,\ldots,bn_i,j);$$

wherein the second red brightness normalized signals corresponding to the backlight subarea comprise r'n_1, 1,r'n_1,2, . . . , r'n_i,j, the second green brightness normalized signals corresponding to the backlight subarea comprise g'n_1,1,g'n_1,2, . . . , g'n_i,j, and the second blue brightness normalized signals corresponding to the backlight subarea comprise b'n_1,1, b'n_1,2, . . . , b'_i,j; wherein the average signal r'n_ave of the second red brightness normalized signals, the average signal g'n_ave of the second green brightness normalized signals, and the average signal b'n_ave of the second blue brightness normalized signals satisfy the following formulas:

$$r'n_\text{ave}=\text{Average}(r'n_1,1,r'n_1,2,\ldots,r'n_i,j);$$

$$g'n_\text{ave}=\text{Average}(g'n_1,1,g'n_1,2,\ldots,g'n_i,j);$$

$$b'n_\text{ave}=\text{Average}(b'n_1,1,b'n_1,2,\ldots,b'n_i,j).$$

7. The driving method of claim 5, wherein let the first light source adjustment coefficient be x and the second light source adjustment coefficient be y, the following formulas are satisfied: $midn_ave=x^x mid'n_ave$, $minn_ave=y^x min'n_ave$.

8. The driving method of claim 1, wherein the operation of determining the minimum color light source among the first color light source, the second color light source, and the third color light source, and obtaining the light source adjustment coefficient corresponding to the minimum color light source based on the first saturation signal and the second saturation signal comprises:

determining a maximum color light source, a middle color light source, and the minimum color light source among the first color light source, the second color light source, and the third color light source; obtaining a light source adjustment coefficient corresponding to the maximum color light source, a light source adjustment coefficient corresponding to the middle color light source, and the light source adjustment coefficient corresponding to the minimum color light source, based on the first saturation signal and the second saturation signal;

wherein the operation of adjusting the minimum color light source using the light source adjustment coefficient to obtain the fourth brightness value, and driving the minimum color light source using the fourth brightness value comprises:

adjusting the minimum color light source using the light source adjustment coefficient corresponding to the minimum color light source, adjusting the light source adjustment coefficient corresponding to the middle color light source to obtain a fifth brightness value, and adjusting the maximum color light source to obtain a sixth brightness value; and driving the minimum color light source using the fourth brightness value, driving the middle color light source using the fifth brightness value, and driving the maximum color light source using the sixth brightness value.

9. The driving method of claim 1, wherein the backlight module comprises at least one backlight subarea, and wherein each of the at least one backlight subarea comprises a first color light source, a second color light source, and a third color light source that are independently controlled;

wherein the driving method further comprises the following operations subsequent to the operation of receiving the first color signal corresponding to the display panel and obtaining the first saturation signal and the second saturation signal:

separately calculating an average signal of all the first saturation signals and an average signal of all the second saturation signals corresponding to the backlight subarea;

wherein the operation of determining the minimum color light source among the first color light source, the second color light source, and the third color light source, and obtaining the light source adjustment coefficient corresponding to the minimum color light source based on the first saturation signal and the second saturation signal comprises: determining the minimum color light source among the first color light source, the second color light source, and the third color light source, and obtaining a minimum light source adjustment coefficient corresponding to the minimum color light source based on the average signal of the first saturation signal and the average signal of the second saturation signal.

10. The driving method of claim 9, wherein the operation of converting the second saturation signal into the second color signal comprises: converting the second saturation signal into second brightness normalized signals, and converting the second brightness normalized signals into the second color signal.

11. The driving method of claim 10, wherein the operation of obtaining the minimum light source adjustment coefficient corresponding to the minimum color light source based on the average signal of the first saturation signal and the average signal of the second saturation signal comprises:

the minimum light source adjustment coefficient y satisfies the following formula:

$$y=(Sn_ave-1)/(S'n_ave-1),$$

where Sn_ave is the average signal of the first saturation signal, and S'n_ave is the average signal of the second saturation signal.

12. The driving method of claim 11, wherein the first brightness normalized signals comprise a first red brightness normalized signal rn_i,j, a first green brightness normalized signal gn_i j, and a first blue brightness normalized signal bn_i,j;

wherein the second brightness normalized signals comprise a second red brightness normalized signal r'n_ij, a second green brightness normalized signal g'n_ij, and a second blue brightness normalized signal b'n_i,j;

wherein the operation of adjusting the first saturation signal of the first HSV spatial signal to obtain the second saturation signal and the second brightness normalized signals corresponding to the second saturation signal comprises:

adjusting the first saturation signal Sn_i,j to obtain the second saturation signal S'n_i,j according to the following formula:

$$S'n_i,j=a\times S^4n_i,j+b\times S^3n_i,j+c\times S^2n_i,j+d\times Sn_i,j+e;$$

where a, b, c, d, e are preset adjustment coefficients and are constants;

and wherein the minimum value in the first brightness normalized signals is adjusted based on the first saturation signal Sn_i,j and the second saturation signal S'n_i,j thus obtaining the second brightness normalized signals according to the following formulas:

according to Sn_i,j=1−minn_i,j/maxn_i,j, keep maxn_i,j unchanged, and only reduce minn_i,j to obtain the second saturation signal Sn_i,j'=1−min'n_i,j/maxn_i,j, and the minimum value min'n_i,j in the second brightness normalized signals, where $$maxn_i,j=Max(rn_i,j,gn_i,j,bn_i,j)=Max(r'n_i,j,g'n_i,j,b'n_i,j);$$

$$mid_i,j=Mid(rn_i,j,gn_i,j,bn_i,j);i,j=Min(rn_i,j,gn_i,j,bn_i,j);\text{ and}$$

$$mid'n_i,j=Mid(r'n_i,j,g'n_i,j,b'n_i,j);min'n_i,j=Min(r'n_i,j,g'n_i,j,b'n_i,j);$$

and wherein the operation of separately calculating the average signal of all the first saturation signals and the average signal of all the second saturation signals corresponding to the backlight subarea comprises:

calculating an average value of all the first saturation signals in the backlight subarea:

$$Sn_ave=Average(Sn_1,1,Sn_1,2,\ldots,Sn_i,j);\text{ and}$$

calculating an average value of all the second saturation signals in the backlight subarea:

$$S'n_ave=Average(S'n_1,1,S'n_1,2, \ldots ,S'n_i,j).$$

13. The driving method of claim 12, wherein the operation of adjusting the minimum color light source using the minimum light source adjustment coefficient comprises: obtaining a third saturation signal corresponding to each of all pixels in the backlight subarea, and calculating an average signal of the third saturation signals;

and wherein the operation of obtaining the minimum light source adjustment coefficient corresponding to the minimum color light source based on the average signal of the first saturation signals and the average signal of the second saturation signals comprises:

assuming the maximum value in the average values of the brightness normalized signals corresponding to the average signal S'n_ave of the second saturation signal and the maximum value in the average values of the brightness normalized signals corresponding to the average signal S"n_ave of the third saturation signal are equal to first maximum average value maxn_ave corresponding to the average signal Sn_ave of the first saturation signals;

obtaining the minimum light source adjustment coefficient y, making that the third color saturation average value S"n_ave obtained after adjusting the minimum color light source using the average signal S'n_ave of the second saturation signals corresponding to the backlight subarea satisfy the following formula: S"n_ave=Sn_ave, then according to the following three formulas:

$$S'n_ave=1-min'/maxn_ave;$$

$$S''n_ave=1-min'*y/maxn_ave; \text{ and}$$

$$Sn_ave=1-minn_ave/maxn_ave;$$

we get:

$$y=(Sn_ave-1)/(S'n_ave-1);$$

where minn_ave is the first minimum average value among the average value of the first red brightness normalized signals, the average value of the first green brightness normalized signals, and the average value of the first blue brightness normalized signals of the backlight subarea, maxn_ave is the first maximum average value among the average value of the second red brightness normalized signals, the average value of the second green brightness normalized signals, and the average value of the second blue brightness normalized signals of the backlight subarea, and min' is the minimum signal corresponding to the second brightness normalized signals.

14. The driving method of claim 9, wherein the operation of determining the minimum color light source among the first color light source, the second color light source, and the third color light source, and obtaining the minimum light source adjustment coefficient corresponding to the minimum color light source based on the average signal of the first saturation signal and the average signal of the second saturation signal further comprises:

determining the middle color light source among the first color light source, the second color light source, and the third color light source; obtaining a middle light source adjustment coefficient based on the first brightness normalized signals and the second brightness normalized signals;

and wherein the operation of adjusting the minimum color light source using the minimum light source adjustment coefficient to obtain the fourth brightness value, and driving the minimum color light source using the fourth brightness value further comprises:

adjusting the middle color light source using the middle light source adjustment coefficient to obtain a fifth brightness value, and driving the middle color light source using the fifth brightness value.

15. The driving method of claim 14, wherein the first brightness normalized signals comprise a first red brightness normalized, a first green brightness normalized signal, and a first blue brightness normalized signal;

the second brightness normalized signals comprise a second red brightness normalized signal, a second green brightness normalized signal, and a second blue brightness normalized signal;

wherein in each backlight subarea, calculating a first maximum average value, a first middle average value, and a first minimum average value among an average value of the first red brightness normalized signals, an average value of the first green brightness normalized signals, and an average value of the first blue brightness normalized signals; calculating a second maximum average value, a second middle average value, and a second minimum average value among an average value of the second red brightness normalized signals, an average value of the second green brightness normalized signals, and an average value of the second blue brightness normalized signals;

wherein the operation of obtaining the middle light source adjustment coefficient based on the first brightness normalized signals and the second brightness normalized signals comprises:

Letting the middle light source adjustment coefficient be x, obtaining x through the following formula: midn_ave=x*mid'n_ave; where midn_ave is the first middle average value, and mid'n_ave is the second middle average value.

16. The driving method of claim 14, wherein the first maximum average value maxn_ave, the first middle average value midn_ave, the first minimum average value minn_ave, the average value rn_ave of the first red brightness normalized signals, the average value gn_ave of the first green brightness normalized signals, and the average value bn_ave of the first blue brightness normalized signals satisfy the following formulas:

$$maxn_ave=Max(m_ave,gn_ave,bn_ave);$$

$$midnave=Mid(m_ave,gn_ave,bn_ave); \text{ and}$$

$$minn\ ave=Min(m_ave,gn_ave,bn\ ave);$$

wherein the second maximum average value max'n_ave, the second middle average value mid'n_ave, the second minimum average value min'n_ave, the average value r'n_ave of the second red brightness normalized signals, the average value g'n_ave of the second green brightness normalized signals, and the average value b'n_ave of the second blue brightness normalized signals satisfy the following formulas:

$$max'n_ave=Max(r'n_ave,g'n_ave,b'n_ave);$$

$$mid'n_ave=Mid(r'n_ave,g'n_ave,b'n_ave); \text{ and}$$

$$min'n_ave=Min(r'n_ave,g'n_ave,b'n_ave).$$

17. The driving method of claim 16, wherein the first red brightness normalized signals corresponding to the backlight subarea comprise rn_1,1, rn_1,2, . . . , rn_i,j, the first green brightness normalized signals corresponding to the backlight subarea comprise gn_1,1, gn_1,2, . . . , gn_i,j, and the first blue brightness normalized signals corresponding to the backlight subarea comprise bn_1,1, bn 1,2, . . . , bn_i,j; wherein the average value rn_ave of the first red brightness normalized signals, the average value gn_ave of the first green brightness normalized signals, and the average value r'_ave of the first blue brightness normalized signals satisfy the following formulas:

$$rn_ave=\text{Average}(rn_1,1,rn_1,2, \ldots ,rn_i,j);$$

$$gn_ave=\text{Average}(gn_1,1,gn_1,2, \ldots ,gn_i,j); \text{ and}$$

$$bn_ave=\text{Average}(bn_1,1,bn_1,2, \ldots ,bn_i,j);$$

wherein the second red brightness normalized signals corresponding to the backlight subarea comprise r'n_1, 1, r'n_1,2, . . . , rn_i,j, the second green brightness normalized signals corresponding to the backlight subarea comprise g'n_1,1,g'n_1,2, . . . , g'n_ij, the second blue brightness normalized signals corresponding to the backlight subarea comprise b'n_1,1, b'n_1,2 . . . , b'n_i,j, the average value r'n_ave of the second red brightness normalized signals, the average value g'n_ave of the second green brightness normalized signals, and the average value b'n_ave of the second blue brightness normalized signals satisfy the following formulas:

$$r'n_ave=\text{Average}(r'n_1,1,r'n_1,2, \ldots ,r'n_i,j);$$

$$g'n_ave=\text{Average}(g'n_1,1,g'n_1,2, \ldots ,g'n_i,j);$$

$$b'n_ave=\text{Average}(b'n_1,1,b'n_1,2, \ldots ,b'n_i,j).$$

18. A driving, system of a display assembly using a driving method of the display assembly, the driving system comprising a driving circuitry of a display panel and a driving circuitry of a backlight module that is synchronously driven with the display panel;

the backlight module comprises a plurality of independently controlled light sources, comprising a first color light source, a second color light source, and a third color light source; a corresponding light source brightness of the first color light source is a first brightness value, a corresponding light source brightness of the second color light source is a second brightness value, and a corresponding light source brightness of the third color light source is a third brightness value;

wherein the driving circuitry of the display panel comprises:

a receiver, configured for receiving a first color signal corresponding to the display panel, converting the first color signal into first brightness normalized signals, and converting the first brightness normalized signals into a first HSV (hue, saturation, value) signal;

an adjuster, configured for adjusting a first saturation signal of the first HSV spatial signal using a preset adjustment coefficient to obtain a second saturation signal;

a converter, configured for converting the second saturation signal into a second color signal; and a driver, configured for driving the display panel using the second color signal;

wherein driving circuitry of the backlight module comprises:

a light source receiver, configured for receiving the first color signal corresponding to the display panel, and obtaining the first saturation signal and the second saturation signal;

a light source determiner, configured for determining a minimum color light source among the first color light source, the second color light source, and the third color light source, and obtaining a light source adjustment coefficient corresponding to the minimum color light source based on the first saturation signal and the second saturation signal; and a light source adjuster, configured for adjusting the minimum color light source using the light source adjustment coefficient to obtain a fourth brightness value; and a light source driver, configured for driving the minimum color light source using a fourth brightness value.

19. The driving system of claim 18, wherein the driving circuitry of the backlight module further comprises:

a light source calculator, configured for separately calculating an average signal of all the first saturation signals and an average signal of all the second saturation signals corresponding to a backlight subarea.

20. A display device comprising a display assembly and a driving system of the display assembly, the driving system of the display assembly comprising a driving circuitry of a display panel and a driving circuitry of a backlight module that is synchronously driven with the display panel;

the backlight module comprises a plurality of independently controlled light sources, comprising a first color light source, a second color light source, and a third color light source; a corresponding light source brightness of the first color light source is a first brightness value, a corresponding light source brightness of the second color light source is a second brightness value, and a corresponding light source brightness of the third color light source is a third brightness value;

wherein the driving circuitry of the display panel comprises:

a receiver, configured for receiving a first color signal corresponding to the display panel, converting the first color signal into first brightness normalized signals, and converting the first brightness normalized signals into a first HSV (hue, saturation, value) signal;

an adjuster, configured for adjusting a first saturation signal of the first HSV spatial signal using a preset adjustment coefficient to obtain a second saturation signal;

a converter, configured for converting the second saturation signal into a second color signal; and a driver, configured for driving the display panel using the second color signal;

wherein driving circuitry of the backlight module comprises:

a light source calculator, configured for receiving the first color signal corresponding to the display panel, and obtaining the first saturation signal and the second saturation signal;

a light source determiner, configured for determining a minimum color light source among the first color light source, the second color light source, and the third color light source, and obtaining a light source adjustment coefficient corresponding to the minimum color light source based on the first saturation signal and the second saturation signal; and a light source adjuster, configured for adjusting the minimum color light source using the light source adjustment coefficient to obtain a fourth brightness value; and a light source driver, configured for driving the minimum color light source using the fourth brightness value;

wherein the display assembly comprises a display panel and a backlight module.

* * * * *